US007534953B2

(12) United States Patent
Kergomard et al.

(10) Patent No.: US 7,534,953 B2
(45) Date of Patent: May 19, 2009

(54) METHOD FOR SIMULATION AND DIGITAL SYNTHESIS OF AN OSCILLATING PHENOMENON

(75) Inventors: Jean Kergomard, Marseille (FR); Philippe Guillemain, Aubagne (FR); Thierry Voinier, Marseille (FR)

(73) Assignee: Centre National de la Recherche Scientifique, Paris (FR)

( * ) Notice: Subject to any disclaimer, the term of this patent is extended or adjusted under 35 U.S.C. 154(b) by 626 days.

(21) Appl. No.: 10/533,336

(22) PCT Filed: Oct. 31, 2003

(86) PCT No.: PCT/FR03/03264

§ 371 (c)(1),
(2), (4) Date: May 2, 2005

(87) PCT Pub. No.: WO2004/042696

PCT Pub. Date: May 21, 2004

(65) Prior Publication Data

US 2006/0065108 A1 Mar. 30, 2006

(30) Foreign Application Priority Data

Oct. 31, 2002 (FR) ..... 02 13682

(51) Int. Cl.
*G10H 1/06* (2006.01)
*G10H 1/12* (2006.01)
*G10H 5/00* (2006.01)
*G10H 5/02* (2006.01)

(52) U.S. Cl. ..... 84/659; 84/622; 84/661

(58) Field of Classification Search ..... 84/659, 84/622, 661

See application file for complete search history.

(56) References Cited

U.S. PATENT DOCUMENTS 3,878,748 A * 4/1975 Spence ..... 84/723
4,985,690 A * 1/1991 Eguchi et al. ..... 333/222
5,119,427 A * 6/1992 Hersh et al. ..... 381/71.14
5,144,096 A * 9/1992 Kunimoto ..... 84/659
5,157,216 A * 10/1992 Chafe ..... 84/695
5,266,734 A * 11/1993 Komano et al. ..... 84/607
5,272,275 A * 12/1993 Kunimoto ..... 84/661
5,332,862 A * 7/1994 Kakishita et al. ..... 84/659
5,340,942 A * 8/1994 Kunimoto ..... 84/661
5,359,146 A * 10/1994 Funaki et al. ..... 84/624
5,459,280 A * 10/1995 Masuda et al. ..... 84/622
5,466,884 A * 11/1995 Van Duyne et al. ..... 84/661
5,703,313 A * 12/1997 Pierce et al. ..... 84/622

(Continued)

*Primary Examiner*—Jeffrey Donels
*Assistant Examiner*—Christina Russell
(74) *Attorney, Agent, or Firm*—Young & Thompson

(57) ABSTRACT

A method for digital simulation of a non-linear interaction between an excitation source and a wave in a resonator, and is particularly applicable, to real-time synthesis of digital signals representing an oscillating phenomenon such as the sound produced by a musical instrument. The invention is characterized in that it consists in calculating the digital signals from equations whereof the solution corresponds to the physical representation of the phenomenon to be simulated which is expressed, each time and in each point of the resonator, by a relationship of impedance or of admittance between two variables representing the effect and the cause of the phenomenon and in directly transcribing the equation of the impedance or of the admittance in the form of a linear filter including delays, so as to produce a non-linear interaction between the two variables of the impedance or admittance relationship.

29 Claims, 7 Drawing Sheets

U.S. PATENT DOCUMENTS 5,748,513 A * 5/1998 Van Duyne ..... 708/320
5,824,927 A * 10/1998 Tonon ..... 84/375
6,752,018 B2 * 6/2004 Goldmeer et al. ..... 73/589
6,766,288 B1 * 7/2004 Smith ..... 704/207
6,906,532 B2 * 6/2005 Slates ..... 324/691
2006/0201312 A1 * 9/2006 Zinato ..... 84/622

* cited by examiner

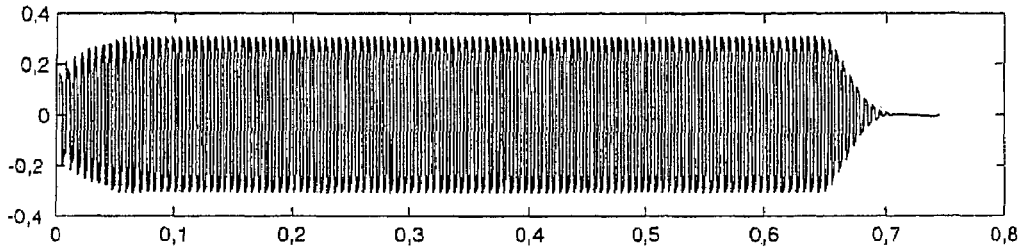
FIGURE 8a
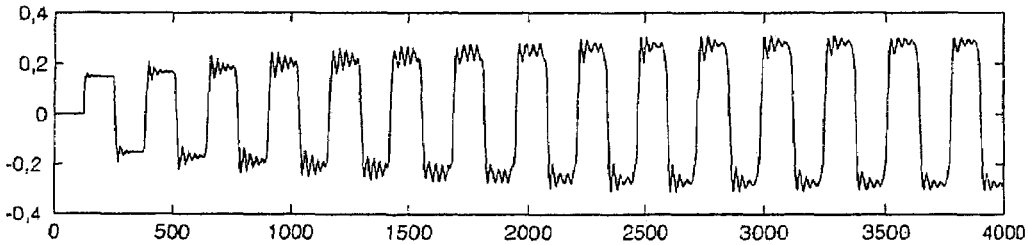
FIGURE 8b
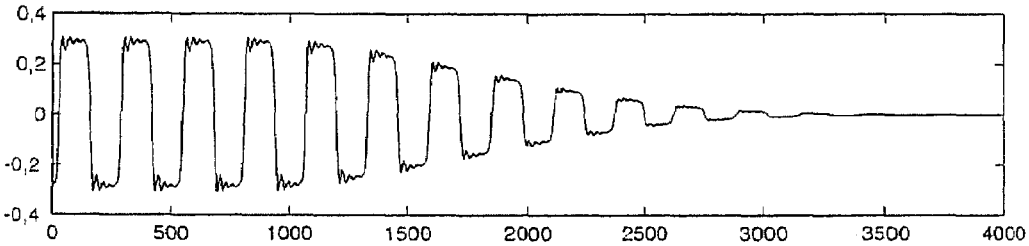
FIGURE 8C
FIGURE 8
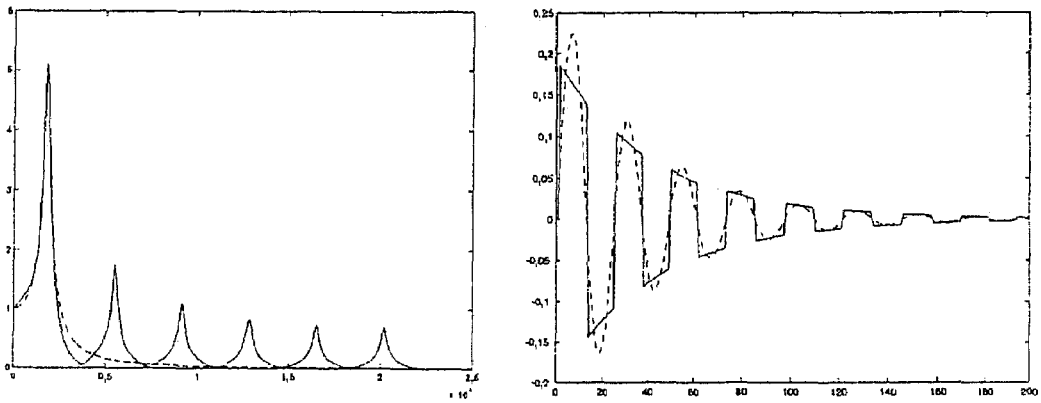
FIGURE 9

METHOD FOR SIMULATION AND DIGITAL SYNTHESIS OF AN OSCILLATING PHENOMENON

BACKGROUND OF THE INVENTION

1. Field of the Invention

The invention refers to a digital simulation method of a non-linear interaction between an excitation source and a wave in a resonator and may be applied, in particular, to the digital synthesis, in real time, of an oscillating phenomenon such as the sound emitted by a musical instrument operating more particularly with sustained oscillations, such as wind or rubbed string instrument.

2. Description of the Related Art

The phenomena of wave propagation and formation of the emitted sounds, in particular, by a musical instrument have been studied scientifically for a very long time.

In particular, it is admitted, generally speaking, that a musical instrument includes, at least, one exciter, characterised by a non-linear characteristic, coupled possibly with certain linear elements (the reed, the lips, the bow, the hammer, etc. . . . ) and resonator elements, generally linear, where there is wave propagation as well as, generally, localised elements (for instance lateral bores or simple elements of the mass or spring type), generally linear as well.

Similarly, a digital instrument capable of synthesising the sounds emitted by a musical instrument, is composed generally of three main elements, respectively a first element, to sense the gests of a musician and to transform them into signals/control parameters, a second element computing the signal in real time, a third element converting this series of numbers calculated into a sound signal by means of digital/analogue converters, amplifier, loudspeakers.

The present invention concerns mainly the second real time calculation element of the signal.

It is known that the digital simulation of a sound or, more generally, of an oscillating phenomenon, may be conducted by discretisation in the time domain of equations forming the mathematic representation of the physical phenomenon to be simulated. Such a model is always expressed in the form of a system of equations with coupled partial derivations, linear or non-linear.

The simulation then consists, generally speaking, in computing as quickly as possible the solution of the acoustic/mechanical model describing the operation of the instrument or, at least, approximations preserving its most important characteristics.

Numerous methods exist to that effect and it is possible, in particular, to mention modal methods (which describe the resonator as a resonant filter comprised of a sum of elementary resonances), particular methods (which describe the medium wherein there is a wave propagation in the form of chains of the type mass-springs-dampers), or the digital methods for solving equations with partial derivations.

However, real time sound synthesis is difficult to realise and consequently, for some years, other methods have been developed, based on a "signal processing" formalism of the propagation in both directions of the resonator of the instrument. One may quote, for instance the methods called "digital wave guide" or "digital wave filter".

Generally speaking, to represent the propagation of a wave, one may use, in the simplest formalism, the well known d'Alembert's equation, which applies to longitudinal waves (acoustic for instance) as well as transversal waves (vibration of a string for instance). In particular, in the case of the propagation of an acoustic wave, the acoustic pressure in all points of the resonator of a wind instrument may be split into a sum of two waves of acoustic pressure, one propagating from the player to the horn, and the other from the horn to the player, which are called away-wave and return-wave.

In practice, such propagation is expressed by a convolution equation (linear filtering), which yields the away wave (or return wave) at one point of the resonator at each time in relation to the away wave (or return wave) at another point at each instant. In the so-called Green formulation, which may be implemented in digital form, d'Alembert's equation specifies for instance that this linear filter, called Green core, is a pure delay, depending on the speed of propagation in the medium and on its length.

In a synthesis model, these waves, respectively away and return waves, are represented by two signals corresponding respectively to both propagative solutions of the differential equation.

Such a synthesis method is implemented, for instance in the document U.S. Pat. No. 5,332,862 which describes a synthesiser comprising generally speaking:

- one non-linear part, simulating the exciter, to which two control parameters of the sound to be simulated are applied. These parameters are, in this case, the pressure of the player's breath and the pressure of his lips on the reed or the mouthpiece,
- a linear part, simulating the resonator, which receives a signal noted $q_0$, representative of the away wave, emitted by the non-linear part, and which emits a signal noted $q_1$, representative of the return wave towards said part,
- a means for creating the sound from the signals derived from the linear part and the non-linear part,
- a digital/analogue converter generating the synthesised sound.

Obviously, there are other types of synthesisers but, until now, all the methods involving a modelization the physical phenomena within the instrument were based on the decomposition of the vibration inside the resonator in terms of away wave and return wave variables.

Still, it has appeared that such methods exhibited several shortcomings.

First of all, when the acoustic resonator is formed, for instance, of several parts of cylindrical tubes of different diameters, the section change causes the generation of a transmitted wave and of a reflected wave at each interface. The phenomenon has been taken into account for a long time, for instance, within the framework of the modelization of the vocal conduit.

This type of modelization, which is identical, in its approach, to the conventional theory of the geometrical optics, is also employed, for instance, in seismic-reflection, in order to describe the propagation of elastic waves in a multilayer ground.

It is known, indeed that it is interesting, in all the cases when one or several waves propagate, to characterise an interface by a diffusion matrix, since it is thus possible to access the reflexions and transmissions of the different waves directly. However, the behaviour of this localised element often becomes difficult to grasp and to calculate, insofar as the interface and continuity equations are always written initially with physical quantities, for instance by expressing, at the interface, the continuity of the pressure or of the flow, of the strength or of the speed.

It is hence often more advantageous to use "impedance" or "admittance" matrices, which link the physical quantities directly, as described in an article of J. Kergomard, "Calculation of discontinuities in waveguides using mode-matching method: an alternative to the scattering matrix approach" J. d'acoustique 4 pp 111-138, (1991)".

On the other hand, when there are localised elements other than interfaces in the instrument to be simulated, the "waveguide" method must be complemented by a "wave filter" type method describing such localised elements (such as mass, spring, dampers) for a correct connection between the various sub-systems.

Similarly, when the acoustic resonator is composed for instance of a conical pipe, the waves moving from the player to the horn (away waves) and from the horn to the player (return waves) are different, which requires, either different modelization, by means of two linear filters corresponding to the Green cores describing the propagation in each direction, or approximating the cone by a succession of short length cylinders of different diameters.

Besides, the sound produced by a musical instrument is not derived solely from the propagation of a wave through a resonator, regardless of the complexity of its geometry, but results from the non-linear coupling between said resonator and an excitation source. Such non-linear coupling is expressed physically between the physical quantities representing a cause (pressure in the acoustic case, strength in the mechanical case) and an effect (flow in the acoustic case, speed in the mechanical case), called Kirchhoff variables. In the acoustic case, this so-called Euler-Bernoulli physical law, a simplified version of the Navier-Stokes equations used in fluid mechanics, specifies that the acoustic pressure, at the reed or the lips of a wind instrument, is proportional, within one additive constant, to the square of the acoustic flow. The formulation of the waves in the resonator in the form of away waves and return waves requires therefore changing the variables enabling the non-linear coupling to be expressed, not in relation to the pressure-flow physical variables any longer, but in relation to these new away-wave and return-wave variables, as for instance, in the aforementioned document U.S. Pat. No. 5,332,862. Still, the variable change introduces an additional complexity in the synthesis method. It is thus that the use of iterative or tabulation methods has been recently suggested to calculate the solution of the non-linear system.

Consequently, the synthesis methods used until now do not enable to simply express the non-linear coupling which exists between the excitation source and the resonator of the instrument and limit the physical parameterisation of the synthesis algorithms.

BRIEF SUMMARY OF THE INVENTION

The invention intends to remedy such shortcomings and to eliminate such limitations thanks to a new real-time simulation and synthesis method of an oscillating phenomenon, applicable especially, but without being limited thereto, to self-oscillating wind instruments. In particular, the invention refers to a simulation method enabling to take into account the physical process governing the operation of a real instrument and where the digital implementation may be particularly simple.

Moreover, from a basic method applicable to instruments such as a clarinet, with a cylindrical resonator, the invention may be adapted to the simulation of other types of wind or string instruments.

Besides, the invention is not limited to the simulation of musical instruments but may be applied, generally to real-time digital synthesis of all sorts of oscillating phenomena.

Generally, the invention therefore relates to the simulation of a non-linear interaction between an excitation source and a wave in a resonator, by means of a digital calculation tool, from equations whose solution corresponds to the physical event of a phenomenon to be simulated.

According to the invention, the phenomenon to be simulated is translated, at each time and at a given point of the resonator, by a linear relation between two variables representative of the effect and of the cause of said phenomenon, the impedance or admittance equation is transcribed directly in the form of a digital model enabling to realise a non-linear interaction between the two variables of the impedance or admittance relation.

In this view, the model comprises, on the one hand, at least one linear part representing directly the so-called input impedance or admittance of the resonator, i.e. at the point where the non-linear interaction occurs and, on the other hand, one non-linear part modelization the role of the excitation source of the phenomenon to be simulated.

In particular, for real-time digital synthesis of an oscillating phenomenon, the invention enables, from a system of equations between at least two variables representative of the behaviour of the resonator, to establish an expression of the input impedance or admittance of the resonator in the form of a linear filter including delays, without any decomposition into away-return waves, in order to realise at least one linear part of the model which may be coupled with a non-linear loop involving the evolution of the non-linearity as expressed between the two variables of the impedance or admittance relation of the resonator.

Particularly advantageously, such linear part of the model is composed of the sum of two elementary waveguides fulfilling a transfer function between the two variables of the impedance or admittance relation.

According to another particularly advantageous characteristic, the model is driven by at least two parameters representative of the non-linear physical interaction between the source and the resonator, by means of a loop connecting the output to the input of the linear part and comprising a non-linear function playing the part of an excitation source for the resonator.

Thus, contrary to the synthesis methods used conventionally, the method according to the invention does not involve away and return waves, but expresses directly and digitally the so-called impedance, linear relation between the cause and effect variables, i.e. pressure and flow in the acoustic case, strength and speed in the mechanical case.

Naturally, such relation puts in evidence propagative elements, involving filters and delays, insofar as the physical phenomenon to be simulated is unchanged.

Still, thanks to the method according to the invention, such relation is readily processable in digital form and may then be associated with the non-linear relation expressed physically between the same variables.

As indicated above, the present invention concerns therefore essentially the modelization element of a digital instrument which, from parameters prepared by a control means, such as a gestural sensor operated by the player, computes in real time a signal liable to be transformed into a sound signal by a conversion element.

In particular, for real-time synthesis, by physical modelization, of the sound of a musical instrument resulting from a non-linear coupling between the excitation source and the resonator, the invention enables to solve the system of equations representative of the phenomenon to be simulated by expressing directly and digitally the impedance or admittance linear relation between the cause and effect variables and by associating such linear relation in digital form with the non-linear relation between the same variables. Moreover, in the case of a resonator of a complex geometry, the former may be decomposed into successive elements, in order to combine the elementary linear relations corresponding respectively to each element of the resonator, in order to obtain an impedance or admittance corresponding to the geometry of the instrument.

As already mentioned, the invention applies, in particular, to real-time synthesis of the sound produced by a wind instrument. In such a case, the two variables of the impedance relation are the acoustic pressure and flow at the input of the resonator.

In the case of a cylindrical resonator having one open end, it is particularly advantageous to realise the linear part of the digital transcription model of the impedance equation in the form of a sum of two elementary waveguides having as an excitation source the flow at the input of the resonator and fulfilling the transfer function:

$$Z_e(\omega) = \frac{Pe(\omega)}{Ue(\omega)} = \frac{1}{1+\exp(-2ik(\omega)L)} - \frac{\exp(-2ik(\omega)L)}{1+\exp(-2ik(\omega)L)}$$

wherein:

ω is the wave angular frequency,

Ze(ω) is the input impedance of the resonator,

Pe(ω) and Ue(ω) are the Fourier transforms of the dimensionless values of the pressure and of the flow at the input of the resonator, k(ω) is a function of the wave angular frequency which depends on the phenomenon to be simulated, L is the length of the resonator.

According to another characteristic, each of the two waveguides involves a filter having as a transfer function:

$$-F(\omega)^2 = -\exp(-2ik(\omega)L)$$

and representing a two-way travel of a wave with the sign changing at the open end of the resonator, each waveguide corresponding to a term of the impedance equation.

Such a model may advantageously be driven by the length of the resonator and at least two parameters representative of the non-linear physical interaction between the pressure and flow at the input of the resonator, by means of a loop connecting the output to the input of the linear part and comprising a non-linear function playing the part of an excitation source for the resonator.

In particular, for real-time synthesis of the sounds to be simulated, a formulation is prepared, in the time domain, of the angular frequency response of the resonator, by approximation of the losses represented by the filter by means of an approximated digital filter.

The invention covers other essential characteristics mentioned in the claims and referring, in particular, to the equations used by the digital signal calculation tool and which leads to waveguide models depending on the phenomenon to be simulated.

Indeed, according to an essential characteristic of the invention, the method suggested for the simulation of a simple phenomenon such as the propagation of a wave in a cylindrical resonator, may be adapted in multiple ways for the simulation of more complex phenomena and, in particular, of diverse types of instruments.

In the following description, we shall thus expose in detail the simulation method, the equations used and the model to be implemented for synthesising the sound of an instrument with a reed acoustic cylindrical resonator, such as a clarinet, and then certain adaptations for the simulation of other types of instruments.

BRIEF DESCRIPTION OF THE DRAWINGS

FIG. 8*a* shows the variations, in relation to time expressed in seconds, of the internal acoustic pressure at the mouthpiece of a cylindrical resonator.

FIGS. 8*b* and 8*c* are enlargements of attack and extinction transients.

FIG. 9 provides two diagrams respectively representing, on the left, the transfer function and, on the right, the angular frequency response, for a multimode reed model computed according to the invention.

DETAILED DESCRIPTION OF THE INVENTION

The invention will first of all be described in its application to a clarinet-type wind instrument.

Figure 1:
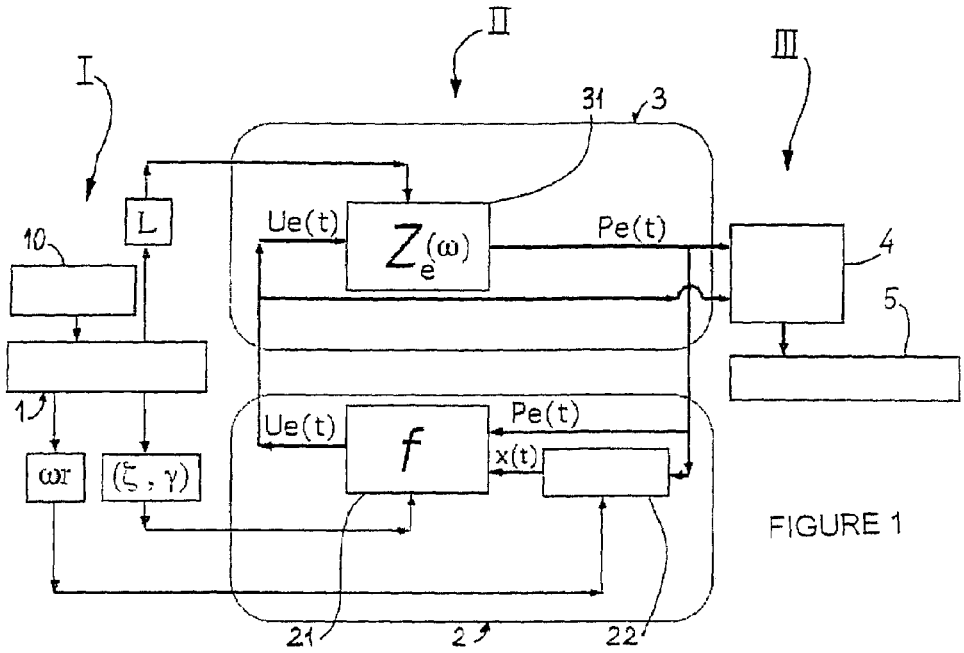
FIG. 1 schematically represents a whole digital instrument for simulating a wind instrument, by the method according to the invention.

FIG. 1 schematically represents a whole digital instrument for the implementation of the invention comprising, generally speaking, a control element I including a gestural sensor 1 controlled by an operator 10 and transforming the actions thereof into control parameters $\omega_r$, $\zeta$, $\gamma$, L, a modelization element II on which the control parameters act, including one non-linear part 2, associated with a linear part 3, and an element III creating the sound, including a means 4 for generating, from signals computed by the modelization element II, a signal which is transformed into sound synthesised by a digital/analogue converter 5. As known, the physical phenomena involved during the production of the sound of the clarinet, are expressed on the one hand, by a linear propagation equation of the waves in the pipe with loss, and on the other hand, by a non-linear equation linking the flow with the pressure and the displacement of the reed at the mouthpiece of the instrument.

A simulation model of the sound therefore includes a linear part of the model corresponding to the resonator of the instrument which, in the case of the clarinet is composed of a cylindrical tube. For such geometry, assuming that the radius of the tube is large relative to the thickness of the boundary layers, the acoustic pressure inside the tube is governed by an equation in the form:

$$\frac{\partial^2 p(x,t)}{\partial x^2} - \frac{1}{c^2}\frac{\partial^2 p(x,t)}{\partial t^2} - \alpha\frac{\partial^{\frac{3}{2}} p(x,t)}{\partial t^{\frac{3}{2}}} = 0$$

$$\text{where } \alpha = \frac{2}{Rc^{\frac{3}{2}}}\left(\sqrt{I_v} + \left(\frac{cp}{cv} - 1\right)\sqrt{I_t}\right).,$$

R being the radius of the tube, i.e. 7 mm in the case of the clarinet. The values of the physical constants, in mKs units, are: c=340, Iv=4.10-8, It=5.6.10-8, $$\frac{Cp}{Cv} = 1.4.$$

While looking for the solutions of the exp (i(ωt−k(ω)x)) type, ω being the angular frequency of the wave, the following may be written:

$$k(\omega)^2 = \frac{\omega^2}{c^2}\left(1 - i\frac{3}{2}\alpha c^2\omega^{-\frac{1}{2}}\right) \tag{1}$$

by replacing $\sqrt{1+x}$ with the approximated value $$1 + \frac{x}{2},$$

when x is small, the conventional approximated expression of k(ω), which will be used below, becomes:

$$k(\omega) = \frac{\omega}{c} - \frac{i^{\frac{3}{2}}}{2}\alpha c\omega^{\frac{1}{2}} \tag{2}$$

We know that, if we consider a pipe of infinite length, supposedly excited at x=0 and t=0 by a unit pulse δ(x)δ(t), in all points x>0, the acoustic pressure propagated from such source is written in the form of a continuous sum of all the waves likely to propagate in the pipe;

$$p(x,t)=\int \exp(-ik(\omega)x)\exp(i\omega t)d\omega$$

which appears as the inverse Fourier transform of the value exp(−ik(ω)).

in the following, the term "waveguide" will be reserved for the so-called Green formulation representing the propagation of a wave in a medium, and including the dissipation and the dispersion.

In this Green formalism, the transfer function of a pipe of length L, representing the propagation, the dissipation and the dispersion is:

$$F(\omega) = \exp(-ik(\omega)L) = \exp\left(-\frac{1}{2}\alpha c\sqrt{\frac{\omega}{2}}L\right)\times\exp\left(-i\left(\frac{\omega}{c}L + \frac{1}{2}\alpha c\sqrt{\frac{\omega}{2}}L\right)\right) \tag{3}$$

The dissipation, represented by the modulus of F(ω), and the dispersion, represented by the phase of F(ω), are therefore proportional to $\sqrt{\omega}$, while the propagation delay is provided by $$\frac{L}{c}.$$

The length of the pipe will be therefore the control parameter of the height and its radius the control parameter of the losses.

We know, on the other hand, that the Fourier transform of the dimensionless pressures and flows at the input (Pe(ω), Ue(ω)) and at the output (Ps(ω), Us(ω)) of the resonator are linked by the system of equations:

$$P_e(\omega)=\cos(k(\omega)L)P_s(\omega)+i\sin(k(\omega)L)U_s(\omega)$$

$$U_e(\omega)=i\sin(k(\omega)L)P_s(\omega)+\cos(k(\omega)L)U_s(\omega)$$

Conventionally, in order to model the internal acoustic pressure, the radiation may be neglected. The open end of the instrument is therefore perfectly reflecting, which involves that Ps(ω)=0. This enables to express the relation between pressure and flow at the input of the resonator $$P_e(\omega)=i\tan(k(\omega)L)U_e(\omega)=Z_e(\omega)U_e(\omega) \tag{4}$$

where Ze(ω)=i tan(k(ω)L) is the normalized input impedance of the resonator.

In the case of a conventional single-mode reed or lips model, the dimensionless displacement x(t) of the reed with respect to its point of equilibrium, and the acoustic pressure pe(t) at the origin thereof, are linked by the equation:

$$\frac{1}{\omega_r^2}\frac{d^2x(t)}{dt^2}+\frac{q_r}{\omega_r}\frac{dx(t)}{dt}+x(t)=\pm p_e(t) \tag{5}$$

with the sign + when the pressure tends to close the reed or the lips and the sign − when the pressure tends to open it, and wherein $\omega_r=2\pi f_r$ corresponds to the resonance frequency $f_r$, for instance 2500 Hz and $q_r$ is the quality factor of the reed, for instance 0.2.

By writing, the equation (5) with the sign + in the Fourier domain, we obtain the transfer function of the reed:

$$\frac{X(\omega)}{Pe(\omega)}=\frac{\omega_r^2}{\omega_r^2-\omega^2+i\omega q_r\omega_r} \tag{6}$$

whereof the angular frequency response is provided by:

$$x(t)=\frac{2\omega_r}{\sqrt{4-qr^2}}\exp\left(-\frac{1}{2}\omega_r q_r t\right)\sin\left(\frac{1}{2}\sqrt{4-qr^2}\,\omega_r t\right) \tag{7}$$

Figure 2:
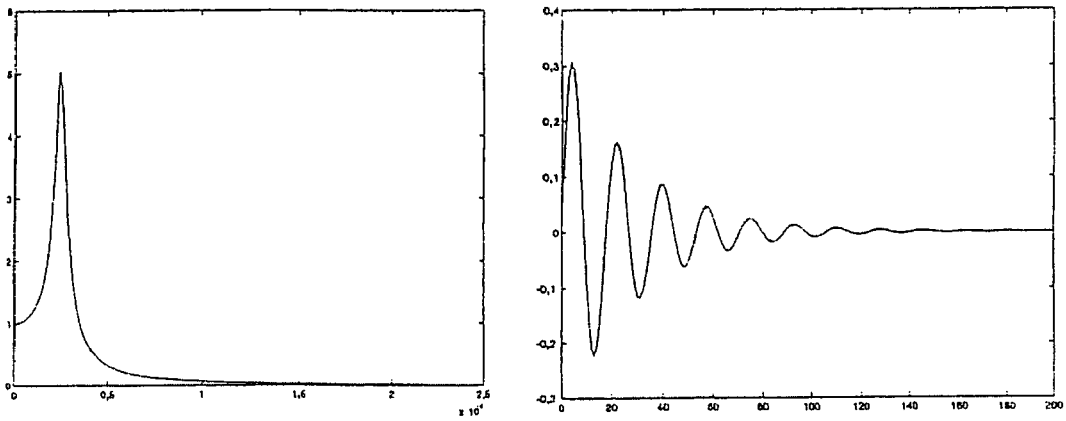
FIG. 2 provides two diagrams respectively representing, on the left, the transfer function, in Hertz, of a single-mode reed model and, on the right, the angular frequency response in relation to the samples, with a sampling frequency of 44,100 Hertz.

For exemplification purposes, FIG. 2 provides two diagrams respectively indicating, on the left, the transfer so function and, on the right, the pulse response of the reed model, for a resonance frequency fr=2 500 Hz and a quality factor $q_r$=0, 2.

As shown below, it should be noted that x(0)=0.

Besides, in the case of a clarinet-type reed instrument or trumpet-type mouthpiece instrument, the acoustic pressure pe(t) and acoustic flow ue(t) (dimensionless) at the input of the resonator are linked in a non-linear manner by the equation:

$$u_e(t)=\frac{1}{2}(1-\mathrm{sign}(\gamma-x(t)-1))\mathrm{sign}(\gamma-p_e(t))\zeta(1-\gamma+x(t))\sqrt{|\gamma-p_e(t)|} \tag{8}$$

In the case of a reed instrument, the parameter ζ is characteristic of the mouthpiece and takes into account the position of the lips and the section ratio between the bill and the resonator. Such parameter ζ is proportional to the square root of the opening of the reed in idle position and usually ranges between 0.2 and 0.6.

The parameter γ is the ratio between the pressure inside the mouth of a player and the plating static pressure of the reed. For a no loss pipe, it ranges from ⅓ for the initiation of vibrations to ½ for the position of a beating reed.

The parameters ζ and γ are therefore two important playing parameters insofar as they represent, respectively, the way the player pinches the reed and the pressure of the breath into the instrument.

While combining the displacement equation of the reed or of the lips, the impedance relation and the non-linear characteristic, it appears that the acoustic pressure and flow, at the mouthpiece, are controlled by the following system of equations:

$$\frac{1}{\omega_r^2}\frac{d^2x(t)}{dt^2}+\frac{q_r}{\omega_r}\frac{dx(t)}{dt}+x(t)=\pm p_e(t) \tag{9}$$

$$P_e(\omega)=i\tan\left(\frac{\omega L}{c}-\frac{i^{3/2}}{2}\alpha c\omega^{1/2}L\right)U_e(\omega) \tag{10}$$

$$u_e(t)=\frac{1}{2}(1-\mathrm{sign}(\gamma-x(t)-1))\mathrm{sign}(\gamma-p_e(t))\zeta(1-\gamma+x(t))\sqrt{|\gamma-p_e(t)|} \tag{11}$$

The aim of the invention is therefore to find a formulation of the impedance relation in the time domain enabling to solve this three-equation system, by modelization the impedance relation in terms of elementary waveguides.

To model the input impedance of the resonator in terms of elementary waveguides, the Fourier transform of the impedance $Z_e(\omega)$ is written in the form:

$$Z_e(\omega)=i\tan(k(\omega)L)=i\frac{\sin(k(\omega)L)}{\cos(k(\omega)L)}=\frac{\exp(ik(\omega)L)-\exp(-ik(\omega)L)}{\exp(ik(\omega)L)+\exp(-ik(\omega)L)}$$

This expression may be written in the form:

$$Z_e(\omega)=\frac{Pe(\omega)}{Ue(\omega)}=\frac{1}{1+\exp(-2ik(\omega)L)}-\frac{\exp(-2ik(\omega)L)}{1+\exp(-2ik(\omega)L)} \tag{12}$$

Figure 3:
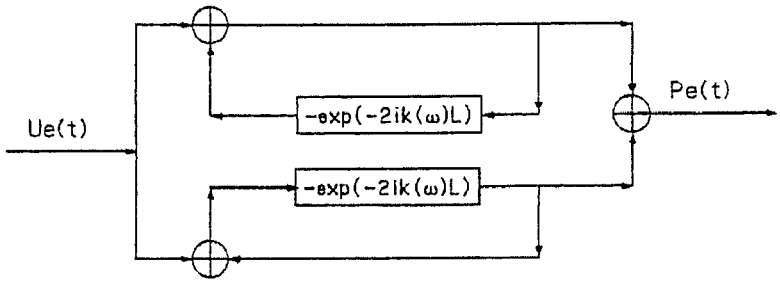
FIG. 3 is diagram per a calculation by combination of waveguides, representing the input impedance of a cylindrical resonator.

FIG. 3 represents a calculation model by combination of waveguides, directly derived from such last equation and whose transfer function is the input impedance of the resonator. It is composed of a sum of two elementary waveguides. The upper element corresponds to the first term of the equation (12) while the lower element corresponds to the second. The filter whose transfer function is $-F(\omega)^2=-\exp(-2ik(\omega)L)$ represents a two-way travel, with a sign change of the acoustic pressure at the open end.

Figure 4:
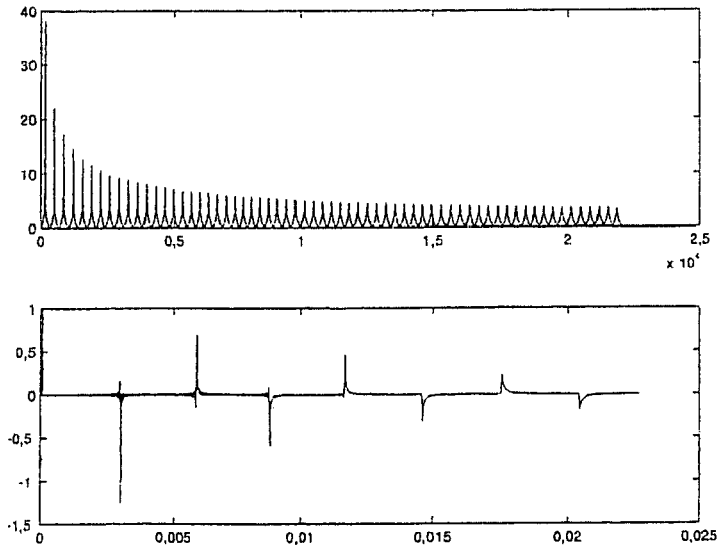
FIG. 4 provides two diagrams respectively representing, for a cylindrical resonator, at the top the input impedance in relation to the frequency expressed in Hertz and, at the bottom, the angular frequency response in relation to time, in seconds.

For exemplification purposes, FIG. 4 provides two diagrams representing respectively, for a pipe of length L=0.5 m and of radius R=7 mm, at the top, the variation of the input impedance of the resonator in relation to the frequency and, at the bottom, the angular frequency response of the corresponding waveguide model, calculated by inverse Fourier transform of the impedance.

The system of the three coupled physical equations (9), (10), (11) enables to introduce the non-linearity in the form of a loop connecting the output pe of the resonator to the input ue.

Figure 5:
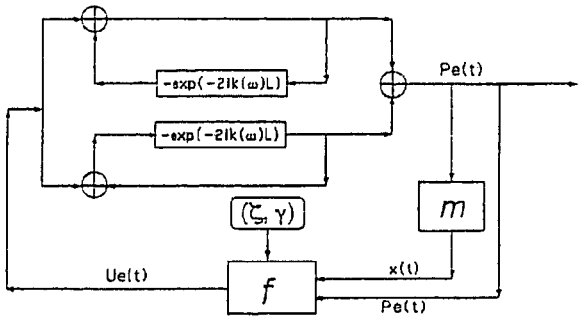
FIG. 5 is a calculation diagram of a simulation model of a cylindrical resonator reed-type instrument.

FIG. 5 provides an equivalent calculation diagram enabling, for the simulation of a reed instrument or mouthpiece instrument, to couple in a non-linear way the displacement of the reed or of the lips and the acoustic pressure with the acoustic flow at the input of the resonator, by computing, at each sampled time, the internal acoustic pressure at the mouthpiece.

The model is entirely driven by the length L of the resonator and at least two parameters ζ and γ representative of the non-linear physical interaction between the source and the resonator, by means of a loop connecting the input to the output of the linear part and comprising a non-linear function playing the part of an excitation source for the resonator. As shown on FIG. 4, the linear part takes up the diagram of FIG. 2 and the non-linear function f is controlled by both parameters ζ and γ enabling to simulate the performance of a player, and has as input parameters, in the case of a clarinet, the pressure at the mouthpiece and the displacement x(t) of the reed with respect to its equilibrium point, computed in relation to the pressure at the mouthpiece, by a reed model (m) which forms the exciter.

No input signal is necessary, insofar as γ is directly proportional to the pressure in the mouth of the player. It is therefore the non-linearity itself, and its evolution imposed by the player, which plays the part of the excitation source, according to the physical model.

For real-time synthesis of the sounds to be simulated, the model requires digital sampling and, to do so, a formulation is prepared, in the time domain, of the angular frequency response of the resonator, corresponding to the inverse Fourier transform of the impedance. Such formulation in the time domain enables to calculate the pressure pe(t) at the mouthpiece in relation to the flow ue(t) but, to do so, it is necessary to approximate the losses represented by the filter F(ω) by means of an approximated digital filter. We shall therefore use an approximation of the transfer function of the filter, $-F(\omega)^2=-\exp(-2ik(\omega)L)$, where the coefficients are determined from physical variables such as the length of the resonator and its radius, in order to be able to make the necessary modifications in relation to the geometry of the resonator. In this view, we express analytically the coefficients of the digital filter as functions of physical parameters.

In practice, it is particularly advantageous to use a single-pole filter while expressing the transfer function approximated in the form:

$$\tilde{F}(\varpi) = \frac{b_0 \exp(-2i\varpi D)}{1 - a_1 \exp(-i\varpi)} \tag{13}$$

wherein $$\varpi = \frac{\omega}{f_e},$$

fe being the sampling frequency, and $$D = f_e \frac{L}{c}$$

is the pure delay corresponding to an away or return travel of the waves in the resonator.

The parameters b0 and a1 are expressed in relation to the physical parameters so that $|F(\omega)^2|^2=|\tilde{F}(\overline{\omega})|^2$ for two provided values of ω.

The first value adopted ω1 is that of the fundamental play frequency. This enables to ensure a down-slope time of the fundamental frequency of the angular frequency response of the waveguide model using the approximated filter, identical to that of the waveguide model using the exact filter.

The second adopted value ω2 is that of a harmonic selected in order to obtain global identical decrease in the angular frequency responses of the waveguides, respectively, exact and approximate waveguides.

The selection of such second value ω2 is therefore less restricted. It corresponds, for instance, to the second resonance peak in the case of the clarinet but, in certain cases, as shown below in the case of the trumpet it may be preferable to select a higher rank harmonic.

The system of equations to be solved is provided by:

$$|F(\omega_1)^2|^2(1 + a_1^2 - 2a_1 \cos(\varpi_1)) = b_0^2$$

$$|F(\omega_2)^2|^2(1 + a_1^2 - 2a_1 \cos(\varpi_2)) = b_0^2$$

$$\text{wherein } |F(\omega)^2|^2 = \exp\left(-2\alpha c\sqrt{\frac{\omega}{2}L}\right).$$

By neglecting the dispersion introduced by the non-linear to part of the phase of F(ω), the frequencies of the harmonics are:

$$\varpi_k = \frac{c\pi\left(k - \frac{1}{2}\right)}{Lfe}$$

where 2k−1 is the rank of the harmonic.

By noting:

$$c_1=\cos(\overline{\omega}_1),\ c_2=\cos(\overline{\omega}_2),\ F_1=|F(\omega_1)^2|^2,\ F_2=|F(\omega_2)^2|^2,\ A_1=F_1c_1,\ A_2=F_2c_2,$$

the coefficients a1 and b0 are provided by:

$$a_1 = \frac{A1 - A2 - \sqrt{(A_1 - A_2)^2 - (F_1 - F_2)^2}}{F_1 - F_2} \tag{14}$$

$$b_0 = \frac{\sqrt{2F_1F_2(c_1 - c_2)(A_1 - A_2 - \sqrt{(A_1 - A_2)^2 - (F_1 - F_2)^2})}}{F_1 - F_2} \tag{15}$$

From the expression of the input impedance of the resonator:

$$Ze(\omega) = \frac{1}{1 + \exp(-2ik(\omega)L)} - \frac{\exp(-2ik(\omega)L)}{1 + \exp(-2ik(\omega)L)},$$

and by noting $z=\exp(i\overline{\omega})$, we obtain directly:

$$\frac{P_e(z)}{U_e(z)} = \frac{1}{1 + \left(\frac{b_0}{1 - a_1z^{-1}}\right)z^{-2D}} - \frac{\left(\frac{b_0}{1 - a_1z^{-1}}\right)z^{-2D}}{1 + \left(\frac{b_0}{1 - a_1z^{-1}}\right)z^{-2D}} = \frac{1 - a_1z^{-1} - b_0z^{-2D}}{1 - a_1z^{-1} + b_0z^{-2D}}$$

wherefrom the differential equation is derived:

$$p_e(n)=u_e(n)-a_1u_e(n-1)-b_0u_e(n-2D)+a_1p_e(n-1)-b_0p_e(n-2D) \tag{16}$$

Figure 6:
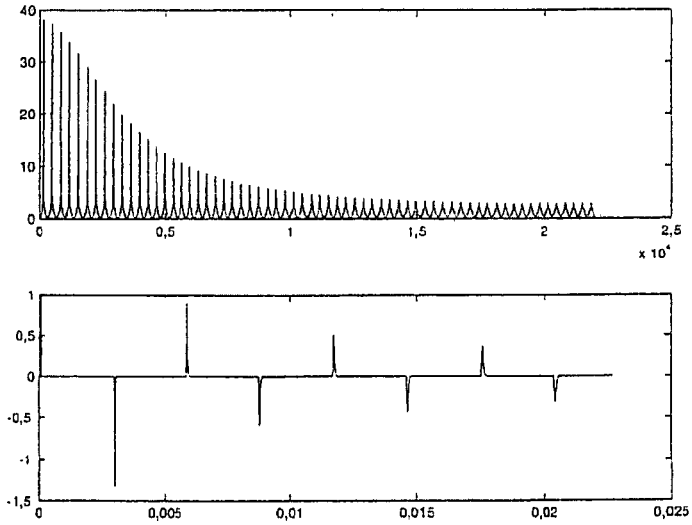
FIG. 6 provides two diagrams similar to FIG. 3, representing respectively, for a resonator model computed according to the invention, at the top the approximated input impedance and at the bottom the approximated impulse response.

FIG. 6 provides two diagrams respectively showing, at the top the variation of the input impedance of the resonator approximated in relation to the frequency and, at the bottom, the angular frequency response of the corresponding waveguide model, calculated from the differential equation for a cylindrical pipe having a length L=0.5 m and a radius R=7 mm.

It can be noted that the model thus established provides a angular frequency response very close to that of the resonator, represented in FIG. 2.

As well as for the filter representing the losses, the relation between the acoustic pressure and the displacement of the exciter (reed or lips) must be discretized in the time domain. Or, the angular frequency response of the reed is a sinus wave damped exponentially which meets the condition x(0)=0, as already mentioned above. II is therefore possible to build a digital filter for which the displacement of the reed at the time $$t_n = \frac{n}{fe}$$

is function of the acoustic pressure at the time $$t_{n-1} = \frac{n-1}{fe}$$

and not $t_n$. This enables to verify the property x(0)=0 of the continuous system when the reed is subjected to a Dirac excitation. To comply with such condition, instead of using the bilinear transformation to approximate the terms iω and $-\omega^2$, we use, according to the invention, the expressions $$i\omega \approx \frac{fe}{2}(z - z^{-1})$$

and $-\omega^2 \approx f_e^2(z-2+z^{-1})$, which correspond to an exact centred digital second order differentiation.

With these approximations, the digital transfer function of the reed is provided by:

$$\frac{X(z)}{Pe(z)} = \frac{\omega_r^2}{\omega_r^2 + f_e^2(z-2+z^{-1}) + \frac{f_e}{2}(z-z^{-1})q_r\omega_r}$$

$$= \frac{z^{-1}}{\frac{f_e^2}{\omega_r^2} + \frac{f_e q_r}{2\omega_r} - z^{-}\left(\frac{2f_e^2}{\omega_r^2} - 1\right) - z^{-2}\left(\frac{f_e q_r}{2\omega_r} - \frac{f_e^2}{\omega_r^2}\right)}$$

wherefrom the differential equation is derived:

$$x(n)=0\times p_e(n)+b_{1a}p_e(n-1)+a_{1a}x(n-1)+a_{2a}x(n-2) \quad (17)$$

wherein the coefficients b1*a*, a1*a* and a2*a* are defined by:

$$a_{0a} = \frac{f_e^2}{\omega_r^2} + \frac{f_e q_r}{2\omega_r} \quad b_{1a} = \frac{1}{a_{0a}} \quad a_{1a} = \frac{\frac{2f_e^2}{\omega_r^2} - 1}{a_{0a}} \quad a_{2a} = \frac{\frac{f_e q_r}{2\omega_r} - \frac{f_e^2}{\omega_r^2}}{a_{0a}}$$

Figure 7:
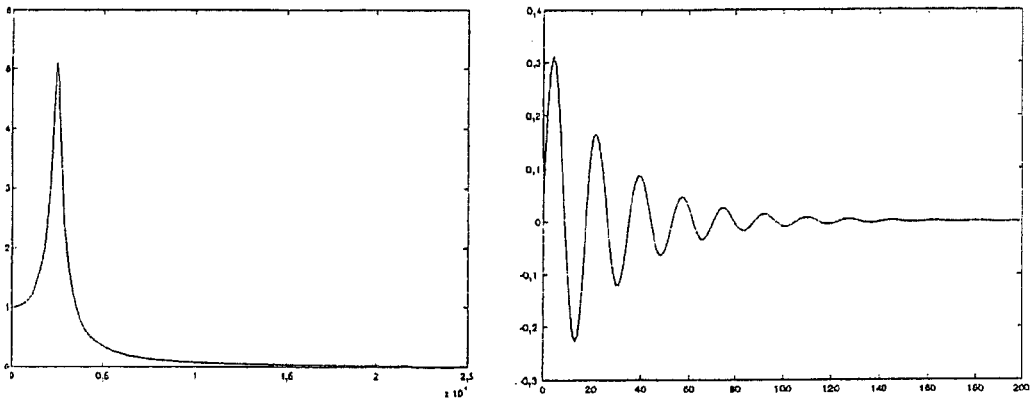
FIG. 7 provides two diagrams similar to FIG. 2, respectively representing, for a reed model computed according to the invention, on the left the transfer function and on the right the angular frequency response.

FIG. 7 provides, for such a reed model approximated, two diagrams representing, on the left the transfer function and on the right the angular frequency response, with a sampling frequency fe=44 100 Hertz, the values of the parameters being fr=2500 Hz and qr=0.2.

It can be seen that the diagrams obtained are very close to those of FIG. 2

This being established, we shall now expose an explicit resolution method, according to the invention, for coupling the differential equations with the non-linear characteristic.

The sampled formulations of the angular frequency responses of the displacement of the reed and of the impedance enable, indeed, to write the sampled equivalent of the system of equations (9, 10, 11) stated above, in the form:

$$x(n) = b_{1a}p_e(n-1) + a_{1a}x(n-1) + a_{2a}x(n-2) \quad (18)$$

$$pe(n) = u_e(n) - a_1u_e(n-1) - b_0u_e(n-2D) + a_1p_e(n-1) - b_0p_e(n-2D) \quad (19)$$

$$u_e(n) = \frac{1}{2}(1 - \mathrm{sign}(\gamma - x(n) - 1))\mathrm{sign}(\gamma - p_e(n))\zeta(1 - \gamma + x(n))\sqrt{|\gamma - p_e(n)|} \quad (20)$$

This system of equations is implicit, because the calculation of $p_e(n)$ by the impedance equation requires to know $u_e(n)$ and such value is itself obtained from the non-linear equation and requires to know $p_e(n)$. Still, as already mentioned above, the calculation of x(n) does not requires to know $p_e(n)$ but to know $p_e(n-1)$ which is indeed known at the time n.

This enables, according to the invention, to solve simply and exactly the coupled system. To do so, the terms of the equations (19) and (20) above, which do not depend on the time sample n, may, indeed, be gathered in the expressions:

$$V = -a_1u_e(n-1) - b_0u_e(n-2D) + a_1p_e(n-1) - b_0p_e(n-2D)$$

$$W = \frac{1}{2}(1 - \mathrm{sign}(\gamma - x(n) - 1)) \times \zeta(1 - \gamma + x(n))$$

which enables to writer $$p_e(n)=u_e(n)+V$$

To generalise the method, it is interesting to associate $u_e$ (n) with a coefficient $bc_0=1$ in the case of a cylindrical pipe.

Both equations (19) and (20) above may then be written in the form;

$$p_e(n)=b_0c_0u_e(n)+V$$

$$u_e(n)=W\mathrm{sign}(\gamma-P_e(n))\sqrt{|\gamma-P_e(n)|}$$

Since the term $$\frac{1}{2}(1 - \mathrm{sign}(\gamma - x(n) - 1))$$

cancels W when (1−γ+x(n)) is negative, W always remains positive. If we successively consider both cases. γ−pe(n)≧0 and γ−pe(n)<0 corresponding respectively to the cases ue(n)≧0 and ue(n)<0, ue(n) may be expressed exactly and without involving the unknown pe(n), in the form:

$$u_e(n) = \frac{1}{2}\mathrm{sign}(\gamma - V)(-bc_0W^2 + W\sqrt{(bc_0W)^2 + 4|\gamma - V|}$$

Consequently, the calculation of the acoustic pressure and the flow at the mouthpiece at a sampled time n, may be conducted by using sequentially the following equations:

$$x(n) = b_{1a}p_e(n-1) + a_{1a}x(n-1) + a_{2a}x(n-2) \quad (21)$$

$$V = -a_1u_e(n-1) - b_0u_e(n-2D) + a_1p_e(n-1) - b_0p_e(n-2D) \quad (22)$$

$$W = \frac{1}{2}(1 - \text{sign}(\gamma - x(n) - 1))\zeta(1 - \gamma + x(n)) \quad (23)$$

$$u_e(n) = \frac{1}{2}\text{sign}(\gamma - V)(-bc_0W^2 + W\sqrt{(bc_0W)^2 + 4|\gamma - V|} \quad (24)$$

$$p_e(n) = bc_0u_e(n) + V \quad (25)$$

Thus, the invention enables to solve in the time domain, the system of equations governing the physical modelization of the instrument, from a sampled formulation equivalent to the angular frequency response of the displacement of the reed, of the impedance relation and of the non-linear characteristic, which is translated into the system of equations (18), (19), (20), wherein:

- the equation (18) is a digital transcription of the model (m) of FIG. 5,
- the equation (19) is a digital transcription of the impedance model of FIG. 3,
- the equation (20) is a digital transcription of the non-linear characteristic linking the displacement of the reed and the acoustic pressure with the acoustic flow.

By grouping the terms which do not depend on the time sample n, the method according to the invention enables, indeed, to determine the flow and the pressure at the input of the resonator by a sequential calculation of the equations (21) to (25), and to solve, in the time domain, the system of equations (9), (10), (11) governing the physical modelization of a clarinet-type reed instrument, in order to synthesise the sounds produced by such an instrument.

For exemplification purposes, FIG. 7 shows the variation of the internal acoustic pressure at the mouthpiece, calculated by such a non-linear model involving waveguides, for a pipe having a length L-0.5 m and a radius R=7 mm, the values of the parameters being $\gamma$=0.4, $\zeta$=0.4, fr=2205 Hz, qr=0.3.

Three phases can be observed: the attack transient corresponding to sudden increase of $\gamma$ and $\zeta$, the steady state while $\gamma$ and $\zeta$ diminish gradually, in a linear manner, up to the oscillation threshold, and the extinction transient.

In practice, the digital implementation of such a non-linear waveguide model, may be conducted with the use of elements available on the market for the gestural sensor. For instance, digital implementation is possible in language C in the form of an external <<clarinet>> object for the environment known under the trade name Max-MSP, driven from MIDI controls supplied by a controller Yamaha WX5®. This controller measures the pressure of the lips on the reed, which controls the parameter $\zeta$, and the pressure of the breath, which controls the parameter $\gamma$. Such information received in MIDI format (therefore between 0 and 127) are re-standardised to correspond to the scale of the physical parameters. The waveguide is tuned from the information MIDI pitch controlled from the finger position which determines the length L of the pipe.

Still, as in a real instrument, the height changes in relation to the physical parameters such as $\gamma$, $\zeta$, $\omega$r and qr. Still, in reality, a musical instrument is not tuned perfectly for all the finger positions. The use of an all-pass filter for the implementation of the fractional part of the delay D is therefore not compulsory.

In practice, it appears that the playing sensations of such to a virtual instrument are quite comparable to those of a real instrument.

Still, the method which has just been described for the simulation of the sound of a clarinet-type reed instrument, may still be perfected.

We know, indeed, that the acoustic pressure at the mouthpiece is not the variable representative of the sound perceived. It is therefore interesting to calculate the external pressure which, for a cylindrical pipe, may be expressed as the time derivate of the outgoing flow:

$$p_{ext}(t) = \frac{du_s(t)}{dt}.$$

By neglecting still the radiation, which involves $p_s(t)=0$, it becomes:

$$P_e(\omega)=i\sin(k(\omega)L))U_s(\omega)$$

$$U_e(\omega)=\cos(k(\omega)L)U_s(\omega)$$

wherefrom we may derive:

$$U_s(\omega)=\exp(-ik(\omega)L)(P_e(\omega)+U_e(\omega))$$

From the perception viewpoint, the term $\exp(-ik(\omega)L)$ is negligible. The expression above may therefore be simplified and becomes:

$$p_{ext}(t) = \frac{d}{dt}(p_e(t) + u_e(t)) \quad (26)$$

Thus, from a digital viewpoint, the calculation, at each sampled time n, of the external pressure $p_{ext}(n)$, is reduced to a simple differential between the sum of the internal pressure and of the flow, between the time n and the time n−1.

As shown in FIG. 1, which represents schematically a whole digital instrument for the implementation of the invention in the case of a wind instrument, the signals $p_e(t)$ and $u_e(t)$ enabling the calculation of the external pressure $p_{ext}(t)$ are prepared by the modelization element II from control parameters $\omega_r$, $\zeta$, $\gamma$, L.

For a cylindrical resonator, such modelization element II is of the type represented in FIG. 5 and enables coupling the three equations (9), (10), (11).

The linear part 3 includes a computing block 31 of the type represented in FIG. 3, the transfer function Ze($\omega$) of which is the input impedance of the resonator.

The model is driven by the length L of the resonator and the non-linear part 2 implements a non-linear function 21 controlled by both parameters $\zeta$ and $\gamma$ and having as input parameters the pressure $p_e(t)$ calculated by the linear part 3 and the displacement x(t) of the exciter 22 calculated, in the case of the clarinet by a reed model (m) in relation to the same pressure $p_e(t)$ at the mouthpiece.

From such pressure $p_e(t)$ and the flow $u_e(t)$ at the mouthpiece, computed respectively by the linear part 3 and the non-linear part 2, the bloc 4 computes the sound signal $p_{ext}(t)$ emitted by the digital instrument thanks to the converter 5.

The method according to the invention has been described in detail for the simulation of a simple instrument, with cylindrical resonator, of the clarinet type.

Still, as will now be seen, the general diagram of FIG. 1 may be applied to the simulation of more complex phenomena.

In particular, physical measurements have shown that the vibrations of a reed are more complex than a simple sine wave damped. It has therefore appeared that the simple model described above could be perfected in order to improve the quality of the sound produced, as perceived. To do so, we consider a very simplified reed model in the form of a free embedded string. Thus, the impedance model of a cylindrical pipe described above, which generates mainly odd harmonics, acts as a basis for the realisation of a multiple mode reed model complying with the same condition x(0)=0, which enables to keep the digital resolution diagram of the equations (21) to (25) specified above.

Since the value of the impedance is real for all the resonance peaks, its angular frequency response is a sum of cosine functions. On the other hand, it has been seen that the angular frequency response of a single mode reed model is a sine wave function. We shall therefore use, in the definition of the model, the transfer function between a damped sine wave and a damped cosine wave. While keeping the same notations, the Fourier transform of $$x(t) = \frac{2\omega_r}{\sqrt{4-qr^2}}\exp\left(-\frac{1}{2}\omega_r q_r t\right)\sin\left(\frac{1}{2}\sqrt{4-q_r^2}\,\omega_r^t\right)$$

is provided by:

$$X(\omega) = \frac{\omega_r^2}{\omega_r^2 - \omega^2 + i\omega q_r \omega_r}.$$

Similarly, the Fourier transform of $$y(t) = \frac{2\omega_r}{\sqrt{4-q_r^2}}\exp\left(-\frac{1}{2}\omega_r q_r t\right)\cos\left[\frac{1}{2}\sqrt{4-q_r^2}\,\omega_r t\right]$$

is provided by:

$$Y(\omega) = \frac{\omega_r(\omega_r q_r + 2i\omega)}{\sqrt{4-q_r^2}\,(\omega_r^2 - \omega^2 + i\omega q_r \omega_r)}.$$

The transfer function between y(t) and x(t) is then:

$$\frac{X(\omega)}{Y(\omega)} = \frac{\sqrt{4-q_r^2}\,\omega_r}{\omega_r q_r + 2i\omega}.$$

We may thus write the transmittance model in the form:

$$\frac{X(\omega)}{P_e(\omega)} = \frac{C\left(1 - B\exp\left(-i\frac{\pi\omega}{\omega_a}\right)\right)}{\left(\frac{1}{2}\omega_r q_r + i\omega\right)\left(1 + B\exp\left(-i\frac{\pi\omega}{\omega_a}\right)\right)}$$

To determine the three unknown variables ωa, C, B, three conditions are set. The first condition consists in keeping the frequency of the first peak, which is the maximum peak. To do so, we select ωa=ωr or assuming that the frequency offset resulting from the quality factor qr can be negligible.

The second condition, satisfied by the single mode reed model, consists in imposing a unit value of the transmittance module for ω=0 in order to maintain X(ω)≈Pe(ω) at low frequencies.

The third condition is an imposed value of $$\frac{1}{q_r}$$

for the transmittance module at the frequency ωr, in order to keep the height of the peak of the single mode reed model.

Thanks to these three conditions, the transfer function thus realised reproduces the main characteristics of the single mode reed model.

Both first and second conditions lead to the system of equations:

$$\frac{2C(1+B)}{\omega_t\sqrt{q_r^2+4}\,(1-B)} = \frac{1}{q_r}$$

$$\frac{2C(1-B)}{\omega_r q_r(1+B)} = 1$$

assuming:

$$A_1 = \frac{2}{\omega_r\sqrt{q_r^2+4}},\ A_2 = \frac{1}{2}\omega_r q_r \text{ and } A_3 = A_2 A_1 q_r,$$

the coefficients B and C solving the system are provided by:

$$B = \frac{1 + A_3 - 2\sqrt{A_3}}{1 - A_3} \tag{27}$$

$$C = \frac{A_3 - \sqrt{A_3}}{\left(\sqrt{A_3} - 1\right)q_r A_1} \tag{28}$$

Similarly to the case of the single mode reed, we shall prepare a digital model wherein the displacement of the reed at the sampled time $$t_n = \frac{n}{f_e}$$

is a function of the acoustic pressure, not at time tn but at time $$t_{n-1} = \frac{n-1}{f_e}.$$

This is possible since the angular frequency response of the model is the sum of damped sine wave functions.

To fulfil such condition, we use an approximation of iω in the form $i\omega \approx f_e(z-1) = f_e(\exp(i\overline{\omega})-1)$.

Moreover, to add to the model an additional control parameter, we replace the coefficient B with a filter such as $$B \approx \frac{b_a}{1 - a_a \exp(-i\varpi)}.$$

Thus, we may adjust the damping of the harmonics in relation to the damping of the fundamental. To keep the characteristic X(0)=1, the parameters $b_a$ and $a_a$ are linked by the equation $$B = \frac{b_a}{1 - a_a}.$$

The term $$\exp\left(-i\frac{\pi\omega}{\omega a}\right)$$

is replaced with its sampled equivalent: $z^{-Da}=\exp(-i\overline{\omega}D_a)$ with the delay $D_a$ defined by:

$$D_a = E\left(\frac{\pi f_e}{\omega_r}\right)$$

wherein E indicates the integer part.

Assuming:

$$\beta = \frac{1}{2}\omega_r q_r,$$

the digital transfer function is written:

$$\frac{X(z)}{P_e(z)} = \frac{C(z^{Da+1} - a_a z^{Da} - b_a z)}{(\beta + fe(z-1))(z^{Da+1} - a_a z^{Da} + b_a z)} = \frac{C\left(z^{-1} - a_a z^{-2} - b_a z^{-Da-1}\right)}{f_e - (f_e(1+a_a) - \beta)z^{-1} - a_a(\beta - f_e)z^{-2} + f_e b_a z^{-Da} - b_a(f_e - \beta)z^{-Da-1}}$$

which leads to the differential equation $$x(n)=b_{a1}p_e(n-1)+b_{a2}p_e(n-2)+b_{aD1}p_e(n-D_e-1)+a_{a1}x(n-1)+a_{a2}x(n-2)+a_{2D}x(n-D_a)+a_{aD1}x(n-D_a-1) \quad (29)$$

wherein the coefficients $a_{a1}$, $a_{a2}$, $a_{aD2}$, $a_{aD1}$ are defined by:

$$a_{a1} = \frac{f_e(1+a_a) - \beta}{f_e},\ a_{a2} = \frac{a_a(\beta - f_e)}{f_e},\ a_{aD} = -b_a,\ a_{aD1} = \frac{b_a(f_e - \beta)}{f_e}$$

and the coefficients $b_{a1}$, $b_{a2}$, $b_{aD1}$ by:

$$b_{a1} = \frac{C}{fe},\ b_{a2} = \frac{-Ca_a}{fe},\ b_{aD1} = \frac{-Cb_a}{fe}.$$

We notice that equation (29), thus established, enables to determine the dimensionless displacement x(n) of the reed at the sampled time n, from previous times.

It appears therefore that, in the case of a multimode reed model, the digital calculation diagram of the sound may be the same as that of the single mode reed while replacing equation (21) with equation (29) which is another digital transcription of the model (m) of FIG. 5.

For exemplification purposes, FIG. 9, which is analogous to FIGS. 2 and 7, provides, for an approximated multimode reed model computed according to the invention, two diagrams representing respectively, in solid lines, on the left, the transfer function and, on the right, the pulse response with a sampling frequency $f_e$=44100 Hertz, the parameters having values $f_r$=1837, 5 Hz, $q_r$=0.2, $a_a$=0.

On the same diagrams, we have superimposed, as doted lines, the transfer function and the angular frequency response of the single reed model as represented in FIG. 7.

According to another development of the invention, we may also improve the sound model of clarinet in order to make it more natural by integrating a certain noise thereto, the system being thus more realistic. Since the noise is created by a turbulence at the reed before the beginning of the pipe, the noise is added to x(t). It appears on the other hand that, in practice, the level of noise depends on the pressure of the breath whereas its <<colour>> depends on the pressure of the lips on the reed. Indeed, from a physical viewpoint, the harder the reed is pressed, the smaller the opening between the reed and the pipe and the greater the turbulence. Therefore we shall use a simple noise model whose level is driven by γ and the brilliance driven by ζ.

For the digital implementation of such a noise model, we shall use a low-pass filter of a white noise. The transfer function of this filter is provided by $$T_b(z) = \frac{b_b(1 - a_b)}{1 - a_b z^{-1}},$$

the coefficient bb being driven by γ, and the coefficient ab driven by ζ. The variation laws of bb and aa may be determined so that the sound simulated by the model is as realistic as possible.

Figure 10:
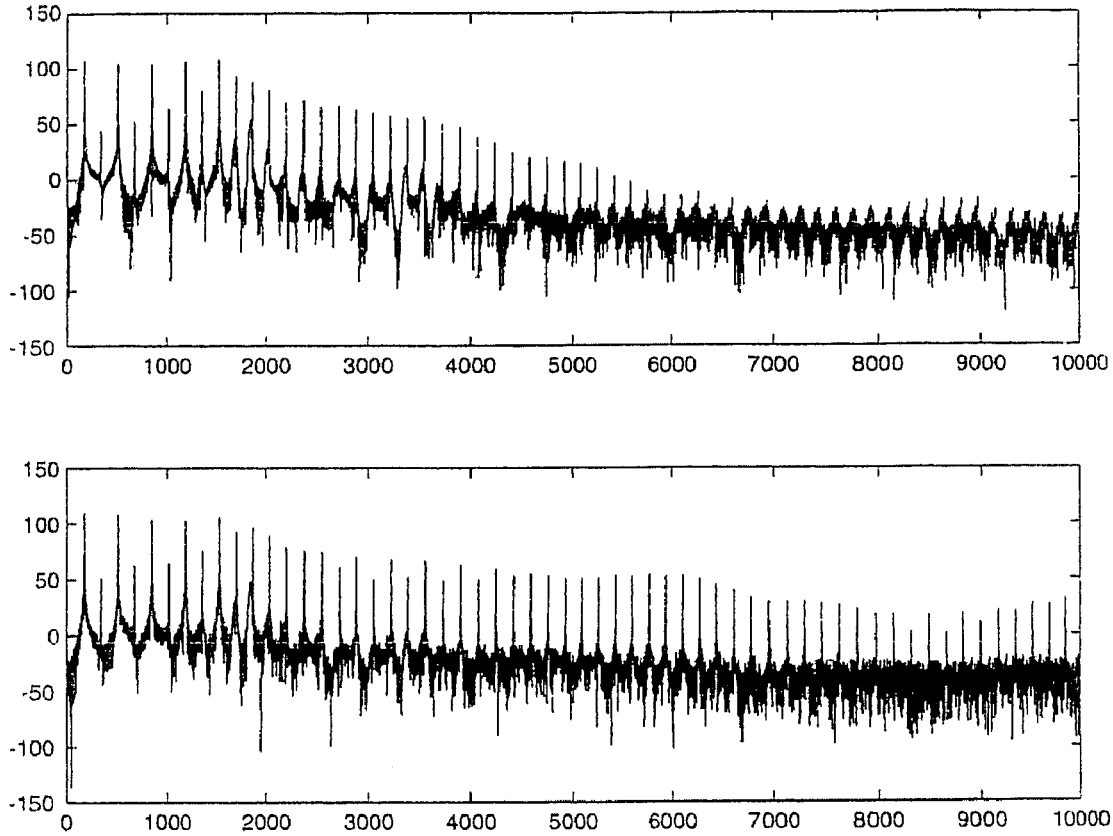
FIG. 10 provides two diagrams representing the spectrum of the external acoustic pressure, respectively, at the top, for a single-mode reed and, at the bottom, for a multiple mode reed.

Both diagrams of FIG. 10 show for exemplification purpose, the variation of the module of the spectrum of the external acoustic pressure corresponding to the sound produced by the model, respectively on the top diagram for a single mode reed and on the bottom diagram for a multiple mode reed with additional noise, the simulation parameters being as follows:

$f_r$=2205 Hz, $q_r$=0.25, $a_a$=0, γ=0.44, ζ=0.4, L=0.48 m, R=7.10$^{-3}$ m

As already mentioned, the method according to the invention, as it has just been described in details, refers to the simulation of sounds produced by a reed and cylindrical resonator musical instrument of the clarinet type. But the invention is not limited to such an application and may, conversely, be subject to numerous developments.

Indeed, from the non-linear physical model, involving waveguides and schematised in FIG. 5, as well as of its digital transcription according to the sequence of equations (21) to (25), it will be possible, to simulate the operation of a resonator having any geometry, by modifying the impedance model for cylindrical resonator and the associated differential equations, to replace the latter with impedances and more complex differential equations.

While keeping the properties of the model which has just been described, it is possible indeed, from the general diagram of FIG. 1, to build other complex impedance models, by combining certain impedance elements in parallel or in series and by offering digital approximations enabling explicit usage of the physical variables and more flexible control of the digital instrument.

For exemplification purposes, we shall now describe certain developments of the basic model for cylindrical resonator, with reference to FIGS. 11 to 14 which represent equivalent calculation diagrams involving waveguides and corresponding to resonators having diverse geometries.

Generally, on these diagrams which correspond to the computing block 31 in FIG. 1, the operator $C(\omega)$ represents the input impedance and $C^{-1}(\omega)$ the input admittance of a cylindrical resonator, the digital model corresponding to $C^{-1}(\omega)$ being obtained by changing the sign of the coefficient $b_0$ only.

A first improvement on the basic model which has just been described with reference to FIGS. 3 and 5, will enable, by the use of wave guides similarly, to realise a physical model for cylindrical resonator with terminal impedance. Such an element will enable, for instance, to link together parts of cylindrical resonators having different lengths and sections, in order to simulate the input impedance of a conduit of variable section, or still to take into account the radiation impedance.

To do so, we consider the formalism of the transmission line linking the acoustic pressure and flow, respectively to the input of the resonator ($P_e(\omega)$, $U_e(\omega)$) and to its open end ($P_s(\omega)$, $U_s(\omega)$).

Noting $$Z_c = \frac{\rho c}{\pi R^2}$$

the impedance characteristic, we have:

$$P_e(\omega) = \cos(k(\omega)L)P_s(\omega) + iZ_c\sin(k(\omega)L)U_s(\omega)$$

$$U_e(\omega) = \frac{i}{Z_c}\sin(k(\omega)L)P_s(\omega) + \cos(k(\omega)L)U_s(\omega)$$

By noting $$Z_s = \frac{P_s(\omega)}{U_s(\omega)}$$

the output impedance and $$R(\omega) = \frac{Z_c - Z_s(\omega)}{Z_c + Z_s(\omega)},$$

we can write the input impedance in two different ways:

$$\frac{P_e(\omega)}{Z_c U_e(\omega)} = \frac{\frac{Z_s(\omega)}{Z_c} + i\tan(k(\omega)L)}{1 + i\frac{Z_s(\omega)}{Z_c}\tan(k(\omega)L)} \tag{30}$$

$$= \frac{1 - R(\omega)\exp(-2ik(\omega)L)}{1 + R(\omega)\exp(-2ik(\omega)L)} \tag{31}$$

The equation (31) shows therefore that the impedance of a cylindrical resonator with terminal impedance may be obtained from the impedance of a cylindrical resonator without terminal impedance, while replacing:

$$\exp(-2ik(\omega)L) \text{ with } R(\omega)\exp(-2ik(\omega)L).$$

Figure 11:
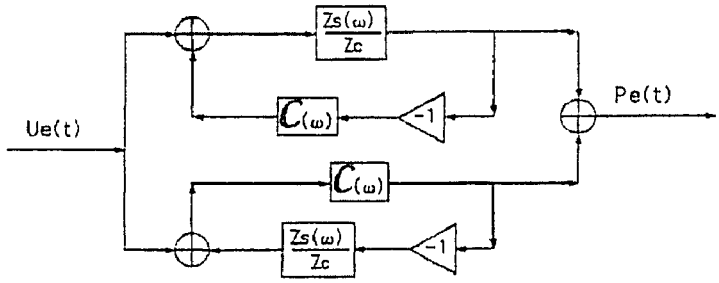
FIG. 11 is a calculation diagram representing the impedance of a cylindrical resonator with terminal impedance.

FIG. 11 provides an equivalent calculation diagram involving waveguides, for the implementation of the equation (30), enabling to calculate the impedance of a cylindrical resonator with terminal impedance.

Such a model enables to generate in cascade the input impedance of a conduit having any geometry and liable to be defined by a succession of elementary cylindrical conduits.

Consequently, the invention may be applied to the simulation of the vocal conduit.

But the invention may be subject to many other developments and the diagram of FIG. 1 enables in particular, from the basic physical model for cylindrical resonator schematised on FIG. 5, to build specific models for the simulation of diverse musical instruments.

It is thus that in a first development of the basic model, we shall build a model for conical resonator, usable, for instance, for the simulation of a saxophone.

If we designate by L the length of the pipe, R its input radius, θ its opening, the distance $x_e$ between the apex of the cone and the input is:

$$x_e = \frac{R}{\left(\sin\frac{\theta}{2}\right)}$$

The input impedance, relative to the characteristic impedance $$Z_c = \frac{\rho_c}{\pi R^2}$$

is then provided by the expression:

$$\frac{P_e(\omega)}{Z_c U_e(\omega)} = \frac{1}{\frac{1}{i\omega\frac{x_e}{c}} + \frac{1}{i\tan(k(\omega)L)}} \tag{32}$$

which may be written in the form:

$$\frac{P_e(\omega)}{Z_c U_e(\omega)} = \frac{i\omega\frac{x_e}{c}}{1 + \frac{i\omega\frac{x_e}{c}}{i\tan(k(\omega)L)}}$$

Figure 12:
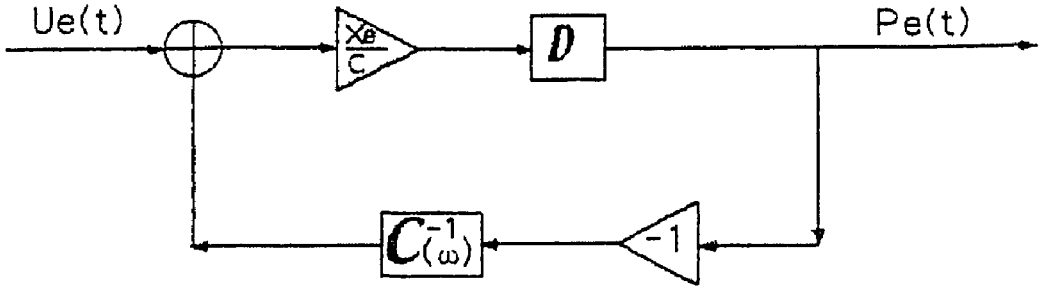
FIG. 12 is a calculation diagram representing the impedance of a conical resonator.

FIG. 12 provides an equivalent calculation diagram involving waveguides, wherein the element noted D is the differential operator $D=i\omega$ and the element noted $C-1(\omega)$ corresponds to the diagram of FIG. 2 by replacing $-\exp(-2ik(\omega)L)$ by $+\exp(-2ik(\omega)L)$.

The corresponding differential equations may be established by following a process similar to that which has been described above.

Thus, using the bilinear transform to approximate iω, the digital transfer function of a conical resonator is provided by:

$$\frac{P_e(z)}{Z_c U_e(z)} = \frac{1}{\frac{z+1}{2fe\frac{xe}{c}(z-1)} + \frac{1-a_1z^{-1}+b_0z^{-2D}}{1-a_1z^{-1}-b_0z^{-2D}}}$$

By noting:

$$Gp = 1 + \frac{1}{2f_e\frac{x_e}{c}} \text{ and } Gm = 1 - \frac{1}{2f_e\frac{x_e}{c}},$$

the transfer function is reduced to:

$$\frac{P_e(z)}{Z_c U_e(z)} = \frac{1-(a_1+1)z^{-1}+a_1z^{-2}-b_0z^{-2D}+b_0z^{-2D-1}}{G_p-(a_1G_p+G_m)z^{-1}+a_1G_mz^{-2}+b_0G_mz^{-2D}-b_0G_pz^{-2D-1}}$$

wherefrom the differential equation is derived:

$$p_e(n)=bc_0u_e(n)+bc_1u_e(n-1)+bc_2u_e(n-2)+bc_Du_e(n-2D)+bc_{D1}u_e(n-2D-1)+ac_1p_e(n-1)+ac_2p_e(n-2)+ac_Dp_e(n-2D)+ac_{D1}p_e(n-2D-1) \quad (33)$$

wherein the coefficients bc0, bc1, bc2, bcD and bcD1 are defined by:

$$bc_0 = \frac{1}{G_p},\ bc_1 = -\frac{a_1+1}{G_p},\ bc_2 = \frac{a_1}{G_p},\ bc_D = -\frac{b_0}{G_p},\ bc_{D1} = \frac{b_0}{G_p}$$

and the coefficients ac1, ac2, acD and acD1 are defined by:

$$ac_1 = -\frac{a_1G_p+G_m}{G_p},\ ac_2 = \frac{a_1G_m}{G_p},\ ac_D = -\frac{b_0G_m}{G_p},\ ac_{D1} = b_0$$

Similarly, the invention may be applied to the case of short resonators which appear, for instance, in the mouthpiece of a brass instrument or in the bill of a reed instrument, or of a register hole or lateral hole.

To do so, it is admitted that the radius of the short resonator is sufficient enough to keep the loss model used until now.

This approximation of a short resonator will consist in approximating the impedance ZI(ω)=i tan(k(ω)I) for small values of k(ω)I.

We thus obtain the expression $$Z_t(\omega) = i\tan(k(\omega)l) \cong l(k(\omega)l) \cong G(\omega) + i\omega H(\omega) \quad (34)$$

$$\text{wherein } G(\omega) = \frac{1-\exp\left(-\alpha c\sqrt{\frac{\omega}{2}}\,l\right)}{1+\exp\left(-\alpha c\sqrt{\frac{\omega}{2}}\,l\right)} \text{ and } H(\omega) = \frac{l}{c}(1-G(\omega)).$$

In another development of the basic model for cylindrical resonator, the invention also enables to simulate a more complex resonator, by assembling elementary impedances representing, in the one hand, the conduit and, on the other hand, the bill of a reed instrument or the mouthpiece of a brass instrument.

In such a case, we shall model the mouthpiece or the bill by a Helmholtz resonator comprising a hemispheric cavity coupled with a short cylindrical pipe and a main resonator with conical pipe.

The input impedance of the resonator assembly may be expressed by:

$$Ze(\omega) = \frac{\frac{1}{Z_n}}{i\omega\frac{V}{\rho c^2} + \frac{1}{Z_1(k_1(\omega)L_1) + Z_2\frac{i\omega\frac{xe}{c}}{1+\frac{i\omega\frac{xe}{c}}{i\tan(k_2(\omega)L_2)}}}}$$

wherein $$V = \frac{4}{6}\pi R_b^3$$

is the volume of the hemispheric cavity, L1 is the length of the short pipe, L2 is the length of the conical pipe, Z1 and Z2 are the characteristic impedances of both pipes which depend on their radii, k1(ω) and k2(ω) take into account the losses and of the radius R1 and R2 of each pipe.

This equation may be written in the form:

$$Z_nZ_e(\omega) = \frac{iZ_1(k_1(\omega)L_1) + Z_2\frac{i\omega\frac{x_e}{c}}{1+\frac{i\omega\frac{x_e}{c}}{i\tan(k_2(\omega)L_2)}}}{1+i\omega\frac{V}{\rho c^2}\left(iZ_1(k_1(\omega)L_1) + Z_2\frac{i\omega\frac{x_e}{c}}{1+\frac{i\omega\frac{x_e}{c}}{i\tan(k_2(\omega)L_2)}}\right)}$$

Figure 13:
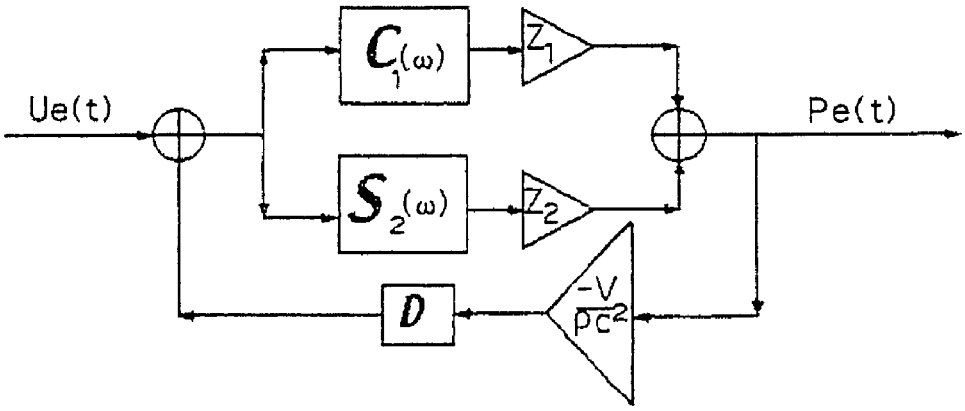
FIG. 13 is a calculation diagram representing the impedance of a resonator for a wind instrument.

We may thus establish the equivalent calculation diagram represented in FIG. 13, wherein the operator noted $C_1(\omega)$ corresponds to the diagram in FIG. 5 and the operator noted S(ω) corresponds to the input impedance of the conical pipe and to the diagram of FIG. 12.

Resolution methods similar to those which have been described previously, enable to express the equivalent digital model and the corresponding differential equations. The impedance of the short pipe may be modelled by using the approximation expressed by the previous equation (34). The impedance of the conical pipe is represented by the model corresponding to the differential equation (33). The admittance of the cavity $$i\omega\frac{V}{\rho c^2}$$

is approximated by the bilinear transformation $$d\frac{z-1}{z+1},$$

where $d=2f_e$.

Considering the association of the hemispheric cavity and of the short pipe as a Helmholtz resonator having as a resonance frequency $$\omega_h = c\sqrt{\frac{S_1}{L_1 V}},$$

we may use such frequency $\omega_h$ to approximate $G(\omega)$ by $G(\omega_h)$ and $H(\omega)$ by $H(\omega_h)$. Both frequencies used for the calculation of the coefficients $a_1$ and $b_0$ are $$\omega_1 = \frac{c(12\pi L + 9\pi^2 x_e + 16L)}{4L(4L + 3\pi x_e + 4x_e)}$$

which correspond to the first impedance peak of the conical pipe, and $\omega_2=\omega_h$. moreover, we shalt use $$Z_n = \frac{\rho c}{S_2} = Z_2$$

to normalize the input impedance.

The digital impedance of a brass-type resonator is thus provided by the expression:

$$Z_e(z) = \frac{\frac{S_n}{\rho c}}{\frac{Vd(z-1)}{\rho c^2(z+1)} + \frac{1}{\frac{\rho c}{S_1}C_1(z) + \frac{\rho c}{S_2}S_2(z)}} \tag{35}$$

which may be simplified in the form $$Z_e(z) = \frac{\sum_{k=0}^{k=4} bc_k z^{-k} + \sum_{k=0}^{k=3} bc_{Dk} z^{-2D-k}}{ac_0 - \sum_{k=1}^{k=4} ac_k z^{-k} - \sum_{k=0}^{k=3} ac_{Dk} z^{-2D-k}}$$

wherefrom the differential equation may be derived $$p_e(n) = \sum_{k=0}^{k=4} bc_k u_e(n-k) + \sum_{k=0}^{k=3} bc_{Dk} u_e(n-k-2D) + \sum_{k=1}^{k=4} ac_k p_e(n-k) + \sum_{k=0}^{k=3} ac_{Dk} p_e(n-k-2D) \tag{36}$$

The coefficients are derived from direct calculation of the equation (35).

The invention may still be applied to the modelization of a cylindrical resonator with register holes. To that effect we use elements involving waveguides and corresponding respectively to a physical model of a cylindrical pipe with terminal impedance representing a pipe of length L1 between the mouthpiece and the register hole, a model of short pipe which represents the register hole of length $h_1$ and the basic model for cylindrical pipe representing a pipe of length L2 between the register hole and the open end.

The terminal impedance of the first part of the pipe may be written:

$$Z_s(\omega) = \frac{1}{\frac{1}{Z_t C_t(\omega)} + \frac{1}{Z_2 C_2(\omega)}}$$

Figure 14:
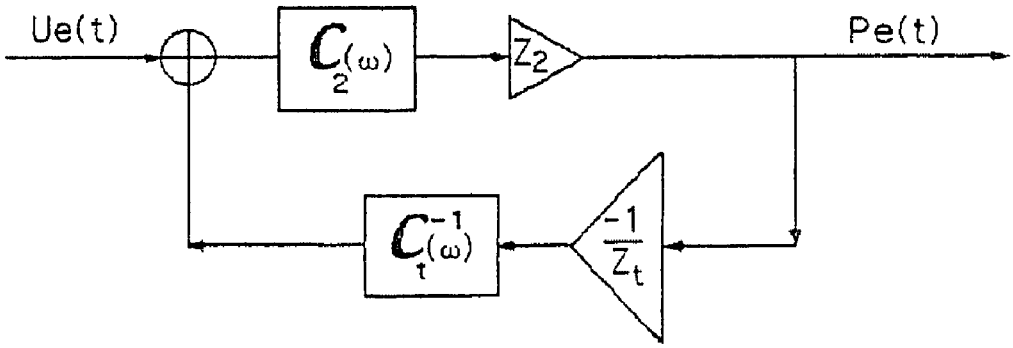
FIG. 14 is a general calculation diagram representing the impedance of a parallel combination of cylindrical resonators.

By writing such expression in the form:

$$Z_s(\omega) = \frac{Z_2 C_2(\omega)}{1 + \frac{Z_2}{Z_t}\frac{C_2(\omega)}{C_t(\omega)}}$$

we may establish a general calculation diagram by waveguides represented on FIG. 14, which, in the case which has just been described, is used to calculate the terminal impedance by a parallel combination of the impedances $Z_2C_2(\omega)$ and $Z_tC_t(\omega)$.

In the limit case of a closed register hole, with two parts of the pipe having the same radius, we assume $Z_tC_t(\omega)=\infty$ and $Z_2=Z_c$ leading to $Z_s(\omega)=iZ_c \tan(k(\omega)L_2)$ and $Z_c(\omega)=iZ_c \tan(k(\omega)(L_1+L_2))$.

The total input impedance of the pipe may then be expressed by:

$$\frac{P_e(\omega)}{Z_c U_e(\omega)} = \frac{(C_2(\omega) + C_1(\omega))Z_t C_t(\omega) + Z_c C_1(\omega) C_2(\omega)}{(1 + C_1(\omega)C_2(\omega))Z_t C_t(\omega) + Z_c C_2(\omega)} \tag{37}$$

Using $i\omega=f_e(1-Z^{-1})$ in the impedance of the short pipe, the differential equation can be derived directly as previously.

Thus, the model for simulating the cylindrical resonator of the clarinet-type, obtained by direct transposition of the simplified equations of the physical behaviour of the instrument, may be adapted to the simulation of instruments with non-cylindrical resonator, such as saxophone, trumpet or other wind instruments.

But the invention is not limited to such an embodiment and to adaptations which have just been described since, without departing from the scope of the claims, it may be applied to the simulation of other types of instruments, for instance when a string is rubbed as with the violin or struck as with the piano.

Indeed, in the case of a string, it is known that using the formalism of mechanical transmission line, analogous to that of an acoustic transmission line, we establish analogous relations between the variables of the impedance relation. Said relations are the strength exerted on the mechanical element, and the speed of such an element resulting from such strength. Insofar as the quantity linked to the sound emitted is linked with the speed (i.e. the effect) in the mechanical case, by opposition to the acoustic case wherein the quantity linked with the sound emitted is the pressure (i.e. the cause), we prefer to describe the resonator in terms of admittance rather than impedance.

The equations of the mechanical transmission line between a point (b) and a point (e) are then:

$$F_e(\omega) = \cos(k(\omega)L)F_b(\omega) + iZ_c\sin(k(\omega)L)V_b(\omega) \tag{38}$$

$$V_e(\omega) = \frac{i}{Z_c}\sin(k(\omega)L)F_b(\omega) + \cos(k(\omega)L)V_b(\omega)$$

wherein F and V represent respectively the strengths and speeds at each point.

The wave number k(ω) is expressed conventionally from the differential equation of the movement of a string under deflection and comprises, as in the acoustic case, propagation (delay), dissipation, dispersion parts (see for instance: C. Valette, C. Cuesta "Mécanique de la corde vibrante", Hermès, treatise on new technologies, série Mécanique. 1993).

If we assume that the end (b) of the string is fixed and the end (e) mobile, we have:

$$V_b = 0 \Rightarrow Y_e(\omega) = \frac{V_e(\omega)}{F_e(\omega)} = \frac{1}{Z_c} i \tan(k(\omega)L)$$

This relation forms the input admittance of a part of embedded-free string at the point where it is free, and is identical, within one multiplying constant, to the acoustic impedance of a cylindrical resonator. It may therefore be represented by a diagram analogous to that of FIG. 3.

At the point where the interaction with the exciter is realised, we write the equations of continuity between both parts of string 1 and 2, by considering that the total strength exerted is the sum of the strengths exerted on each part, while the speeds of each part are equal.

$$F(\omega)=F_1(\omega)+F_2(\omega)$$

$$V(\omega)=V_1(\omega)=V_2(\omega)$$

Assuming that the complete string is fixed at both ends, this enables to express the input admittance of the string from a series combination of each part of the string, i.e., in terms of admittance:

$$Y(\omega) = \frac{V(\omega)}{F(\omega)} = \frac{1}{\frac{1}{Y_1(\omega)} + \frac{1}{Y_2(\omega)}} = \frac{1}{\frac{Z_c}{i\tan(k(\omega)L_1)} + \frac{Z_c}{i\tan(k(\omega)L_2)}} \tag{39}$$

Such a relation is identical, within one constant, to the parallel combination of two cylindrical acoustic resonators and may therefore be represented by the diagram of FIG. 14 wherein the elements noted Ct and C2 represent the admittance of each part of the string.

Figure 15:
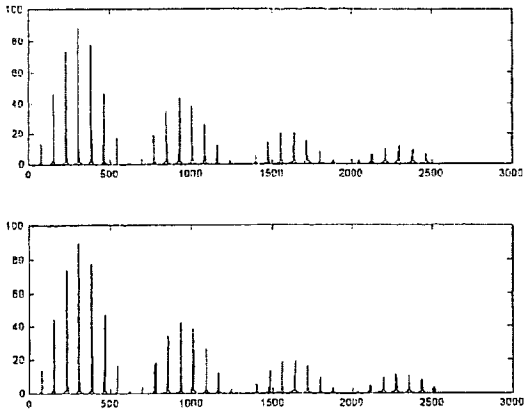
FIG. 15 provides two diagrams respectively representing, in the case of a string, at the top the exact admittance and at the bottom the approximated admittance, in relation to frequency expressed in Hertz.

For exemplification purposes, FIG. 15 represents, in relation to the frequency, at the top, the exact admittance of a string at the eighth of its length, calculated with an expression of k(ω) derived from a conventional model, and, at the bottom, the admittance approximated using an approximation of the losses with a digital first order filter whose coefficients are computed with the same method as in the acoustic case.

It should be noted that, in the case of the violin, the contact point between the bow and the string is very close to one of the ends of the string. Consequently, it is possible to use the <<short pipe>> approximation for the admittance of either of both parts. Moreover, insofar as the losses expressed by k(ω) are very small in a string, it is also possible to neglect it for the short part. Thus, the admittance of a violin string at the contact point with the bow may be expressed in the same manner as the impedance of an acoustic conical resonator and can therefore be represented by the diagram of FIG. 12.

As in the case of acoustic self-oscillating instruments, the admittance described in this basic model comprising a string with two fixed ends, may be refined in order to take into account additional physical phenomena. The method consists again in associating the admittances of different elements. Thus, it is possible with such an approach to build an input admittance of a resonator composed of two strings coupled by a harmonic table, i.e. whose the ends are not fixed any longer, but mobile. Indeed, in most notes of a piano, there are two or three strings tuned to very close frequencies, which are struck simultaneously by the same hammer. In such a case, the total admittance is expressed by an association of two admittances of identical strings, each of these admittances being composed of two parts of strings, one of these parts is expressed identically to the input impedance of a cylindrical pipe with terminal impedance. In the mechanical case, the terminal admittance corresponding to that of the sound board, may be expressed by combinations of localised elements similar to those employed to describe the mouthpiece or the bill (i.e. masses, springs, dampers), enabling to take into account one or several vibration modes of the sound board.

According to the invention, the formulation of the resonator en terms of mechanical admittance may be processed, for instance in an instrument where the string is struck as with the piano. In such a case, and as in the acoustic case, the speed of a string struck by a hammer such as that of a piano, may be expressed from the system with three coupled equations:

$$f(t) = K(y_h(t) - y_s(t))^p\left(1 - \alpha\frac{d}{dt}(y_h(t) - y_s(t))\right) \tag{40}$$

$$\frac{d^2 y_h(t)}{dt^2} = -\frac{1}{M_h}f(t)$$

$$V_s(\omega) = Y(\omega)F(\omega)$$

i.e.:

a non-linear characteristic expressing the strength in relation to the relative displacements and speeds of the hammer and of the string, an equation of the dynamics of the hammer linking its acceleration to the strength exerted by the string thereon by reaction, which is analogous to the expression of the displacement of the reed in relation to pressure, an admittance equation expressing the speed of the string in relation to the strength which is imposed thereupon, which is equivalent to the acoustic impedance relation.

The non-linear impact characteristic used here is known as the Hunt-Crossley characteristic. The exponent (p) ranges conventionally between 2 and 3, and is not an integer. yh(n) designates the displacement of the hammer, ys(n) that of the string. It should be noted that it is here a new way of writing the problem. Indeed, conventionally, the impedance relation used here is replaced with the differential equation of the movement of the string.

Figure 16:
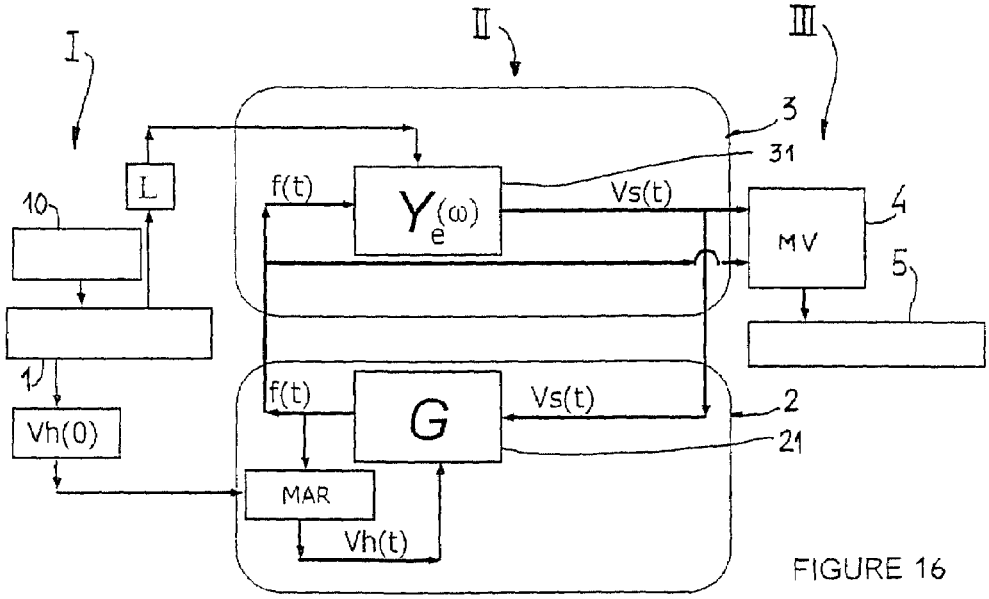
FIG. 16 is a model of a digital instrument simulating a string instrument.

Such a simulation method of a string instrument may be implemented by a digital instrument whereof the model is schematised on FIG. 16 which is analogous to the general diagram of FIG. 1 and wherein:

Ye(ω) designates the input admittance of the resonator;

MA is, in the case of an instrument where the string is struck, a model of hammer, expressing its speed from the strength f(t);

Vs(t) is the speed of the string and Vh(t) that of the hammer;

MV is a calculation model of the speed at the bridge which is then radiated by the sound board, from the strength and the speed of the string at the hammer-string contact point;

G is the non-linear characteristic, and groups the non-linear function and the calculation means of the displacements Yh(t) and Ys(t) from Vh(t) and Vs(t);

Vh(0) is the control parameter acting on the block MA, fixing the initial speed of the hammer at impact;

L is the control parameter of the note played. In the case of an instrument where the string is rubbed, G is the non-linear friction characteristic, whereof numerous models can be found in the literature and whereof the control parameters are the pressure of the bow on the string and its speed of displacement.

In a simplified model, the block MA may be deleted.

In the case of an instrument where the string is struck, the discrete time model involves, as for certain elements of the acoustic models, the bilinear transform to approximate the time derivation operators. By noting W (noted V in the acoustic case) all the independent terms of (n) of the differential equation linking the speed of the string vs(n) and the strength f(n), and vh(n) the speed of the hammer, the transcription of the system of equations above in terms of sampled signals is:

$$f(n) = K(y_h(n) - y_s(n))^p(1 - \alpha(v_h(n) - v_s(n))) \tag{41}$$

$$v_h(n) = v_h(n-1) - \frac{1}{2f_e M_b}(f(n) + f(n-1))$$

$$v_s(n) = c_0 f(n) + W$$

$$y_h(n) = y_h(n-1) + \frac{1}{2f_e}(v_h(n) + v_h(n-1))$$

$$y_s(n) = y_s(n-1) + \frac{1}{2f_e}(v_s(n) + v_s(n-1))$$

Taking into account that the exponent (p) is not an integer, there is no explicit solution to this system, contrary to the acoustic case. By substituting in the first equation the expressions of yh(n) and ys(n) obtained from the two last equations, we obtain a <<fixed point>> type equation:

$$f(n)=(A-Bf(n))^p(C'-Df(n))$$

Although there is no analytical solution, this type of equation is solved conventionally using iterative methods, the easiest being the so-called fixed point method. The regularity in the time domain of the strength f(n) enables to obtain very rapid convergence. Indeed, we observe that two or three iterations are sufficient.

The model is controlled, for the note played, by acting on the resonator (length, diameter, tension of the string). The dynamics are controlled by the initial speed of the hammer, obtained by fixing vh(n=0).

Figure 17:
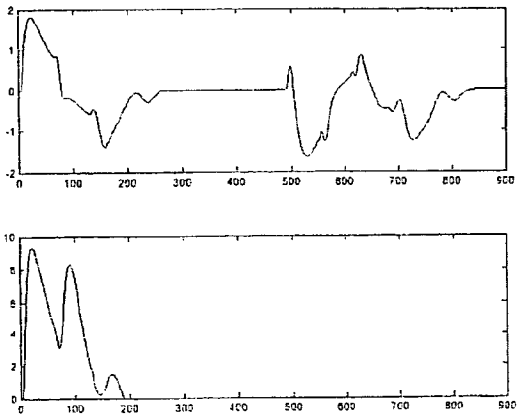
FIG. 17 shows, for a string struck, the time variations, at the top, of the speed of the string at the contact point and, at the bottom, of the strength exerted by the hammer on the string.

For exemplification purposes of realisation, FIG. 17 represents, in relation to time, at the top the speed of the string at the contact point (the eighth of its length), at the bottom the strength exerted by the hammer on the string, solutions of the previous system of equations, solved by the fixed point method.

Figure 18:
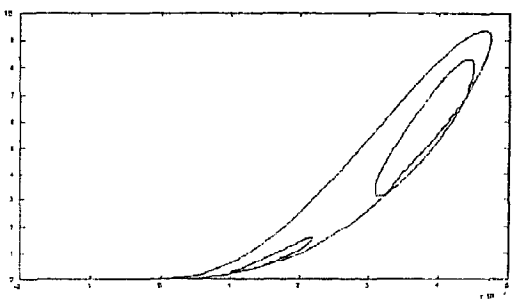
FIG. 18 represents, for a string struck, the trajectory of the strength with time, in relation to relative displacement of the hammer with respect to the string.

Similarly, FIG. 18 represents the time trajectory of the strength in relation to the relative displacement of the hammer with respect to the string.

We have thus described in detail an application of the method according to the invention to the simulation of a string instrument. As for the wind instruments described previously and contrary to the methods known previously, the invention enables to dispense with away-waves and return-wave quantities.

Besides, it should be noted that the simulation model of a string instrument, illustrated in FIG. 16 is very similar to the wind instrument model illustrated on FIG. 1. Indeed, in both cases, they involve linear filters including delays, to realise non-linear interaction between two physical variables, so-called Kirchhoff variables, representative of the effect and of the cause of the phenomenon to be simulated.

It appears therefore that the invention may be generally extrapolated to the simulation of any instrument operating by non-linear coupling between an excitation source and a resonator.

Figure 19:
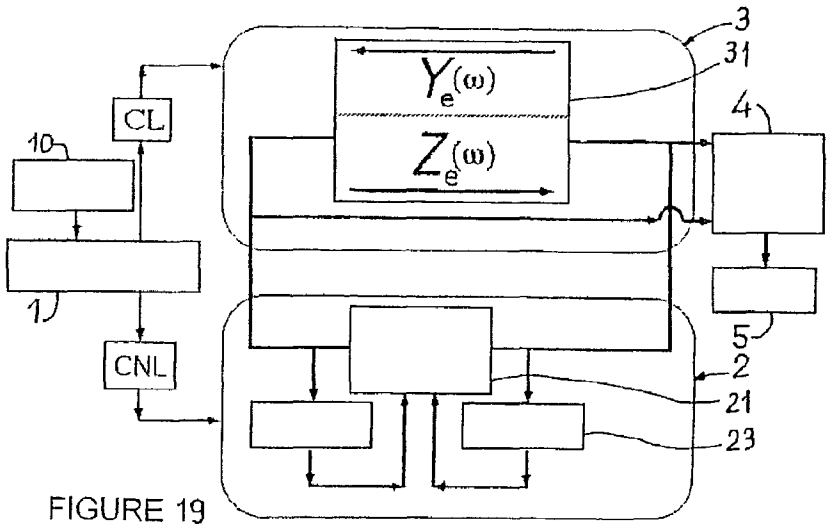
FIG. 19 is a general simulation diagram of an instrument operating by non-linear coupling between an excitation source and a resonator.

For exemplification purposes, FIG. 19 represents the general diagram of the model of such a digital instrument comprising, as usual, a control element I, a modelization element II and an element creating the sound III.

As previously, the modelization element II includes a linear part 3 with a computing block (31) whose transfer function is, according to the instrument to be simulated, either the input impedance of the resonator Ze(ω) or the admittance Ye(ω) and one non-linear part 2 which implements a non-linear function 21.

The block 1 may be a gestural sensor supplying control parameters CL acting on the linear part 3 of the model, and control parameters CNL acting on the non-linear part 2.

According to the direction of the arrows indicated on the block 31 on FIG. 19, the linear part 3 receives from the non-linear part 2, from left to right, when the transfer function of the computing block 31 is the impedance, an effect signal E to produce a cause signal C which is transmitted to the non-linear part 2, the latter producing, from this cause signal C, a new effect signal E bound for the linear part 3.

Conversely, when the transfer function of the computing block 31 is the admittance, the linear part 3 receives from right to left, from the non-linear part 2, a cause signal C and produces an effect signal E which is transmitted to the non-linear part 2 to produce a new cause signal C bound for the linear part 3.

The non-linear part 2 is associated with exciters 23 transforming respectively the cause and effect signals to produce the other variables involved in the non-linear characteristic H.

The block 4 includes calculation means of the sound to be emitted from the cause C and effect E signals, which is transmitted to a digital/analogue converter 5.

The invention thus enables to simulate all sorts of instrument and is not limited, besides, to the field of music.

Indeed, the method according to the invention could be also applied to the simulation of other oscillating phenomena, thanks to an adaptation of certain differential equations and a selection of other non-linear characteristics and of control parameters taking into account the physical characteristics of the phenomena to be simulated.

The invention claimed is:

1. A digital simulation method of a non-linear interaction between an excitation source and a wave in a resonator, by means of digital signal calculation tools based on equations the solution of which corresponds to the physical event of a phenomenon to be simulated which can translated, at each time and at each point of the resonator, by a linear relation between two variables representative of the effect and of the cause of said phenomenon to be simulated comprising:

transcribing the impedance or admittance equation directly into a digital model form enabling to realise a non-linear interaction between the two variables of the impedance or admittance relation, wherein said method is adapted for real-time sound synthesis of a musical instrument comprising, at least, one excitation source with non-linear characteristics and a linear resonator, the sound produced by the instrument resulting from a coupling, between the excitation source and the resonator, expressed at least by a linear impedance or admittance relation and a non-linear relation between two physical variables representative of the effect and of the cause of the sound produced, a method where the sound produced by the instrument is simulated, in real time, by modelization the physical phenomena governing the operation of the instrument, wherein, to realise said physical modelization, the impedance or admittance linear relation is expressed directly and digitally between two physical variables representative of the cause and of the effect of the phenomenon to be simulated and said impedance or admittance relation in digital form is associated with the non-linear relation between the same variables.

2. A method according to claim 1, for simulating an oscillating phenomenon, wherein the digital model comprises, on the one hand at least one linear part (3), representing the input impedance or admittance of the resonator, and, on the other hand, one non-linear part (2) modelization the role of the excitation source (22) of the phenomenon to be simulated.

3. A simulation method according to claim 1, for real time digital synthesis of an oscillating phenomenon, wherein, from a system of equations between at least two variables representative of the behaviour of a wave in the resonator, an expression of the input impedance or admittance of the resonator is established in the form of a linear filter including delays, without any decomposition into two-way waves, in order to realise at least one linear part (3) of the model.

4. A method according to claim 3, wherein the linear part (3) of the model is coupled with one non-linear part (2) involving the evolution of the non-linearity as expressed between the two variables of the input impedance or admittance relation of the resonator.

5. A method according to claim 4, wherein the linear part (3) of the digital simulation model of the impedance or admittance equation in based on to two elementary waveguides fulfilling a transfer function between the two variables of the impedance or admittance relation.

6. A method according to claim 5, wherein the linear part (3) with two waveguides of the model is coupled with a loop connecting the output to the input of said linear part (3) and comprising a function (21) involving the non-linearity as expressed physically.

7. A method according to claim 6, wherein the model is driven by at least two parameters representative of the non-linear physical interaction between the source and the resonator, by means of a loop connecting the output to the input of the linear part (3) and comprising a non-linear function (21) playing the part of an excitation source for the resonator.

8. A method according to claim 1 for synthesis of the sound of an instrument with complex resonator, wherein the resonator is decomposed into a series of successive elements and wherein the impedance or admittance relations corresponding respectively to each element of the resonator are calculated and combined in order to obtain a global impedance corresponding to the geometry of the resonator.

9. A method according to claim 1, wherein, for real-time synthesis of the sound produced by a wind instrument, the two variables of the impedance relation are the acoustic pressure ($p_e$) and flow ($u_e$) at the input of the resonator.

10. A method according to claim 9, wherein, for an open-ended cylindrical resonator, the linear part (3) of the digital transcription model of the impedance equation is the sum of two elementary waveguides having as excitation source the flow ($u_e$) at the input of the resonator, and fulfils the transfer function $$Z_e(\omega) = \frac{Pe(\omega)}{Ue(\omega)} = \frac{1}{1+\exp(-2ik(\omega)L)} - \frac{\exp(-2ik(\omega)L)}{1+\exp(-2ik(\omega)L)} \tag{12}$$

wherein:

ω is the angular frequency of the wave

Ze(ω) is the input impedance of the resonator,

Pe(ω) and Ue(ω) are the Fourier transforms of the dimensionless values of the pressure and of the flow at the input of the resonator;

k(ω) is a function of the angular frequency which depends on the phenomenon to be simulated;

L is the length of the resonator.

11. A method according to claim 10, wherein each of the two waveguides involves a filter having as a transfer function:

$$-F=(\omega)=-\exp(-2ik(\omega)L)$$

and representing a two-way travel of a wave, with a sign change at the open end of the resonator, each waveguide corresponding to a term of the impedance equation.

12. A method according to claim 11, wherein the model is driven by the length (L) of the resonator and at least two parameters (ζ, γ) representative of the non-linear physical interaction between the pressure ($p_e$) and the flow ($u_e$) at the input of the resonator, by means of a loop connecting the output to the input of the linear part (3) and comprising a nonlinear function (21) as an excitation source for the resonator.

13. A method according to claim 10, wherein the non-linear function has the pressure and the displacement of the vibration formation member as input parameters, and is controlled by at least two parameters simulating a player playing.

14. A method according to claim 13, wherein the playing parameters for controlling the non-linear function are:

a parameter ζ characteristic of the mouthpiece and of the action of the player on the vibration formation member, a parameter γ representative of the pressure applied to the vibration formation member.

15. A method according to claim 9, wherein, for real-time synthesis of the sound to be simulated, a formulation is realised in the time domain of the angular frequency response of the impedance of the resonator, by approximation of the losses represented by the filter by means of an approximated digital filter.

16. A method according to claim 15, wherein, to express the angular frequency response of the impedance of the resonator, a one pole digital filter is used of the form:

$$\tilde{F}(\varpi) = \frac{b_0 \exp(-2i\varpi D)}{1 - a_1 \exp(-i\varpi)} \tag{13}$$

wherein:

$$\varpi = \frac{\omega}{f_e},$$

fe being the sampling frequency, $$D = f_e \frac{L}{c}$$

is the pure delay corresponding to an away or return travel of the wave in the resonator, the coefficients bo and a1 are expressed in relation to the physical parameters so that $|F(\omega)^2|^2=|\widetilde{F}(\overline{\omega})|^2$ for a value ω1 of the angular frequency corresponding to the fundamental playing frequency and another value ω2 corresponding to a harmonic, and the following differential equation is derived:

$$p_e(n)=u_e(n)-a_1u_e(n-1)-b_0u_e(n-2D)+a_1p_e(n-1)-b_0p_e(n-2D). \quad (16)$$

17. A method according to claim 16, wherein the coefficients bo and a1 are obtained by solving the equation system:

$$|F(\omega_1)^2|^2(1+a_1^2-2a_1\cos(\overline{\omega}_1))=b_0^2$$

$$|F(\omega_2)^2|^2(1+a_1^2-2a_1\cos(\overline{\omega}_2))=b_0^2$$

with $$|F(\omega)^2|^2 = \exp\left(-2\alpha c\sqrt{\frac{\omega}{2}}L\right),$$

said coefficients being given by the formulae:

$$a_1 = \frac{A1 - A2 - \sqrt{(A_1 - A_2)^2 - (F_1 - F_2)^2}}{F_1 - F_2}$$

$$b_0 = \frac{\sqrt{2F_1F_2(c_1 - c_2)(A_1 - A_2 - \sqrt{(A_1 - A_2)^2 - (F_1 - F_2)^2})}}{F_1 - F_2}$$

wherein $$c_1=\cos(\overline{\omega}_1),\ c_2=\cos(\overline{\omega}_2),\ F_1=|F(\omega_1)^2|^2,\ F_2=|F(\omega_2)^2|^2,\ A_1=F_1c_1,\ A_2=F_2c_2.$$

18. A method according to claim 17, for simulating a cylindrical resonator instrument, from a physical modelization governed by the system of equations:

$$\frac{1}{\omega_r^2}\frac{d^2x(t)}{dt^2} + \frac{q_r}{\omega_r}\frac{dx(t)}{dt} + x(t) = \pm p_e(t)$$

(with the sign + for a reed and the sign − for the lips)

$$P_e(\omega) = i\tan\left(\frac{\omega L}{c} - \frac{i^{3/2}}{2}\alpha c\omega^{1/2}L\right)U_e(\omega)$$

$$u_e(t) = \frac{1}{2}(1 - \mathrm{sign}(\gamma - x(t) - 1))\mathrm{sign}(\gamma - p_e(t))\zeta(1 - \gamma + x(t))\sqrt{|\gamma - p_e(t)|}$$

wherein n ωr is the resonance frequency and gr is the quality factor of the reed or of the lips, wherein that said system of equations is solved in the time domain from an equivalent sampled formulation of the angular frequency response of the displacement of the reed or of the lips and of the impedance relation which is translated by the system of equations:

$$x(n) = b_{1a}p_e(n-1) + a_{1a}x(n-1) + a_{2a}x(n-2) \quad (18)$$

$$p_e(n) = u_e(n) - a_1u_0(n-1) - b_0u_e(n-2D) + a_1p_e(n-1)b_0p_e(n-2D) \quad (19)$$

$$u_e(n) = \frac{1}{2}(1 - \mathrm{sign}(\gamma - x(n) - 1))\mathrm{sign}(\gamma - p_e(n))\zeta n) - \gamma + x(n))\sqrt{|\gamma - p_e(n)|} \quad (20)$$

said equations being used sequentially by grouping the terms not depending on the time sample n, in order to calculate in succession:

$$x(n) = b_{1a}p_e(n-1) + a_{1a}x(n-1) + a_{2a}x(n-2) \quad (21)$$

$$V = -a_1u_e(n-1) - b_0u_e(n-2D) + a_1p_e(n-1) - b_0p_e(n-2D) \quad (22)$$

$$W = \frac{1}{2}(1 - \mathrm{sign}(\gamma - x(n) - 1))\zeta)) - \gamma + x(n)\Big) \quad (23)$$

$$u_e(n) = \frac{1}{2}\mathrm{sign}(\gamma - V)(-bc_0W^2 + W\sqrt{(bc_0W)^2 + 4|\gamma - V|} \quad (24)$$

$$p_e(n) = b_0c_0u_e(n) + V. \quad (25)$$

19. A method according to claim 18, for more realistic simulation of the produced sound, wherein, by neglecting the radiation, the external pressure is expressed as the time derivation of the outgoing flow, in the form:

$$p_{ext}(t) = \frac{d}{dt}(p_e(t) + u_e(t)) \quad (26)$$

and is calculated, at each sampled time (n), by differential between the sums of the internal pressure pe and of the flow ue, respectively at the time (n) and at time (n−1).

20. A method according to claim 18 for simulating a multimode reed instrument, wherein the calculation of the acoustic pressure and of the flow at the mouthpiece is performed by sequential resolution of a system of equations wherein the displacement of the reed at each time(n) is in the form:

$$x(n)=b_{a1}p_e(n-1)+b_{a2}p_e(n-2)+b_{aD1}p_e(n-D_a-1)+a_{a1}x(n-1)+a_{a2}x(n-2)+a_{aD}x(n-D_a)+a_{aD1}x(n-D_a-1)$$

the coefficients aa1, aa2, aaD2, aaD1 being defined by:

$$a_{a1} = \frac{f_e(1 + a_a) - \beta}{f_e},\ a_{a2} = \frac{a_a(\beta - f_e)}{f_e},\ a_{aD} = -b_a,\ a_{aD1} = \frac{b_a(f_e - \beta)}{f_e}$$

and the coefficients ba1, ba2, baD1 by:

$$b_{a1} = \frac{C}{fe},\ b_{a2} = \frac{-Ca_a}{fe},\ b_{aD1} = \frac{-Cb_a}{fe}.$$

$$\beta = \frac{1}{2}\omega_r q_r \text{ et } C = \frac{A_3 - \sqrt{A_3}}{(\sqrt{A_3} - 1)q_r A_1} \tag{28}$$

$$\text{by setting } A_1 = \frac{2}{\omega_r\sqrt{q_r^2 + 4}},\ A_2 = \frac{1}{2}\omega_r q_r \text{ and } A_3 = A_2 A_1 q_r,$$

the following equations being the same as for a single mode reed.

21. A method according to one claim 18, wherein that a model is prepared for a cylindrical resonator with terminal impedance from the basic model corresponding to a cylindrical resonator and being the sum of two waveguides involving each a filter having as a transfer function $-F(\omega)^2 = -\exp(-2ik(\omega)L)$, while replacing the expression $\exp(-2ik(\omega)L)$ by the expression $R(\omega)\exp(-2ik(\omega)L)$, wherein $$R(\omega) = \frac{Z_c - Z_s(\omega)}{Z_c + Z_s(\omega)}$$

Zc being the characteristic impedance $$\frac{\rho c}{\pi R^2} et Z_s$$

the output impedance $$\frac{P_s(\omega)}{U_s(\omega)}.$$

22. A method according to claim 18, wherein, from the impedance model for cylindrical resonator instrument and the associated differential equations, other more complex impedance models are built for simulating oscillating phenomena produced by a resonator of any shape by combining impedance elements in parallel or in series and by using digital approximations for an explicit use of the physical variables involved in the production of said oscillating phenomena and a more flexible control of the result of the simulation.

23. A method according to claim 22, wherein that, from the basic model of a cylindrical resonator wherein the angular frequency response of the displacement of the reed or of the lips is translated by a system of differential equations providing, at each time(n), the displacement x(n) the pressure pe(n) and the flow ue(n) at the input of the resonator, a model for a conical resonator is built wherein the equation of the pressure is in the form:

$$p_e(n) = bc_o u_e(n) + bc_1 u_e(n-1) + bc_2 u_e(n-2) + bc_D u_e(n-2D) + bc_{D1} u_e(n-2D-1) + ac_1 p_e(n-1) + ac_2 p_e(n-2) + ac_D p_e(n-2D) + ac_{D1} p_e(n-2D-1) \tag{33}$$

wherein the coefficients bc0, bc1, bc2, bcD and bcD1 are defined by:

$$bc_0 = \frac{1}{G_p},\ bc_1 = -\frac{a_1 + 1}{G_p},\ bc_2 = \frac{a_1}{G_p},\ bc_D = -\frac{b_{01}}{G_p},\ bc_{D1} = \frac{b_0}{G_p}$$

and the coefficients $ac_1$, $ac_2$, $ac_D$ and $ac_{D1}$ are defined by:

$$ac_1 = -\frac{a_1 G_p + G_m}{G_p},\ ac_2 = \frac{a_1 G_m}{G_p},\ ac_D = -\frac{b_0 G_m}{G_p},\ ac_{D1} = b_0$$

$$\text{by noting } G_p = 1 + \frac{1}{2f_e\frac{x_e}{c}} \text{ and } G_m = 1 - \frac{1}{2f_e\frac{x_o}{c}}.$$

24. A method according to claim 23 wherein that, from the basic model for a cylindrical resonator, a model for a short resonator having a length l is built, by an approximation of the impedance according to the expression:

$$Z_l(\omega) = i\tan(k(\omega)l) \cong G(\omega) + i\omega H(\omega) \tag{34}$$

$$\text{wherein } G(\omega) = \frac{1 - \exp\left(-\alpha c\sqrt{\frac{\omega}{2}}\,l\right)}{1 + \exp\left(-\alpha c\sqrt{\frac{\omega}{2}}\,l\right)} \text{ and } H(\omega) = \frac{l}{c}(1 - G(\omega)).$$

25. A method according to claim 24 for simulating a wind instrument, wherein the mouthpiece or the bill is modelled by a Helmholtz resonator comprising a hemispheric cavity coupled with a short cylindrical pipe and a main resonator with a conical pipe, the input impedance of the resonator assembly which may be expressed as:

$$Z_e(\omega) = \frac{\frac{1}{Z_n}}{i\omega\frac{V}{\rho c^2} + \frac{1}{iZ_1(k_1(\omega)L_1) + Z_2\frac{i\omega\frac{x_e}{c}}{1 + \frac{i\omega\frac{x_e}{c}}{i\tan(k_2(\omega)L_2)}}}}$$

wherein $$V = \frac{4}{6}\pi R_b^3$$

is the volume of the hemispheric cavity, L1 is the length of the short pipe, L2 is the length of the conical pipe, Z1 and Z2 are the characteristic impedances of both pipes which depend on their radii, k1(ω) and k2(ω) take into account the losses and the radius R1 and R2 of each pipe, and that, From the basic model for cylindrical resonator, from its extensions to the conical pipe and to the short pipe, a resonator model is prepared by expressing the pressure at the mouthpiece or in the bill by the differential equation:

$$p_e(n) = \sum_{k=0}^{k=4} bc_k u_e(n-k) + \sum_{k=0}^{k=3} bc_{Dk} u_e(n-k-2D) + \sum_{k=1}^{k=4} ac_k p_e(n-k) + \sum_{k=0}^{k=3} ac_{Dk} p_e(n-k-2D). \tag{36}$$

26. A method according to claim 18, wherein that, from the basic model of a cylindrical resonator wherein the angular frequency response of the displacement of the reed or of the lips is translated by a system of differential equations providing, at each time(n), the displacement x(n) the pressure pe(n) and the flow ue(n) at the input of the resonator, a model for a conical resonator is built wherein the equation of the pressure is in the form:

$$p_e(n)=bc_o u_e(n)+bc_1 u_e(n-1)+bc_2 u_e(n-2)+bc_D u_e(n-2D)+bc_{D1} u_1(n-2D-1)+ac_1 p_e(n-1)+a_{c2} p_e(n-2)+ac_D p_e(n-2D)+ac_{D1} p_e(n-2D-1) \quad (33)$$

wherein the coefficients bc0, bc1, bc2, bcD and bcD1 are defined by:

$$bc_0 = \frac{1}{G_p},\ bc_1 = -\frac{a_1+1}{G_p},\ bc_2 = \frac{a_1}{G_p},\ bc_D = -\frac{b_{01}}{G_p},\ bc_{D1} = \frac{b_0}{G_p}$$

and the coefficients $ac_1$, $ac_2$, $ac_D$ and $ac_{D1}$ are defined by $$ac_1 = -\frac{a_1 G_p + G_m}{G_p},\ ac_2 = \frac{a_1 G_m}{G_p},\ ac_D = -\frac{b_0 G_m}{G_p},\ ac_{D1} = b_0$$

by noting $G_p = 1 + \frac{1}{2 f_e \frac{x_e}{c}}$ and $G_m = 1 - \frac{1}{2 f_e \frac{x_e}{c}}$.

27. A method according to claim 18 wherein that, from the basic model for a cylindrical resonator, a model for a short resonator having a length l is built, by an approximation of the impedance according to the expression:

$$Z_l(\omega) = i \tan(k(\omega)l) \cong G(\omega) + i\omega H(\omega) \quad (34)$$

wherein $G(\omega) = \frac{1 - \exp\left(-\alpha c \sqrt{\frac{\omega}{2}}\, l\right)}{1 + \exp\left(-\alpha c \sqrt{\frac{\omega}{2}}\, l\right)}$ and $H(\omega) = \frac{1}{c}(1 - G(\omega))$.

28. A method according to claim 1, for the simulation of an oscillating phenomenon wherein both physical variables of the linear relation are the strength applied to one point of a mechanical system such as a string generating vibrations and the speed at this point, wherein that the admittance is expressed, at this point, in the form of a combination of the admittances of each part of the string, on both sides of said point, each mechanical admittance being obtained from the basic model describing the acoustic impedance of a cylindrical pipe resonator, by expressing the speed at the point considered of the string in relation to the strength applied to this point, where the filter F(ω) of the basic model may be expressed from a bending wave propagation model in a having a stiffness.

29. A digital device to implement the method according to claim 1, for the simulation of a musical instrument generating a sound resulting from a coupling between a linear resonator and an excitation source with a non-linear characteristic, which can be expressed at least by a linear impedance or admittance relation and a non-linear relation between two variables representative of the effect and of the cause of the produced sound, said simulation device comprising a control element I including at least one gestural sensor 1 transforming the actions of a player into control parameters, a modelization element II including one non-linear part (2) associated with a linear part (3) and an element creating the synthesised sound III, wherein that the linear part (3) includes a computing block (31) driven by the length (L) of the resonator, having as an input parameter a signal representative of one of the variables, cause or effect, computed by the nonlinear part (2), and the transfer function of which is the input impedance or admittance of the resonator, in that the non-linear part (2) implements a nonlinear function (21) driven by at least two control parameters and having as input parameters a signal representative of the other variable, cause or effect, computed by the linear part (3) and a signal modelization the role of the excitation source, the linear part (3) being thus coupled with the non-linear part (2) in a closed loop, and in that the element creating the sound III computes a sound signal from signals representative of the cause and of the effect of the sound to be simulated, emitted respectively by the linear part (3) and the non-linear part (2).

* * * * *